US012545480B2

(12) United States Patent
Erickson et al.

(10) Patent No.: US 12,545,480 B2
(45) Date of Patent: Feb. 10, 2026

(54) LOCKING PIN FOR TOOL CASE

(71) Applicant: MILWAUKEE ELECTRIC TOOL CORPORATION, Brookfield, WI (US)

(72) Inventors: Matthew J. Erickson, Waukesha, WI (US); Flevian J. Gonsalves, New Berlin, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 50 days.

(21) Appl. No.: 18/741,043

(22) Filed: Jun. 12, 2024

(65) Prior Publication Data

US 2024/0425245 A1 Dec. 26, 2024

Related U.S. Application Data

(60) Provisional application No. 63/509,438, filed on Jun. 21, 2023.

(51) Int. Cl.
*B65D 43/22* (2006.01)

(52) U.S. Cl.
CPC ..... *B65D 43/22* (2013.01)

(58) Field of Classification Search
CPC ..... B65D 43/22; B25H 3/02
See application file for complete search history.

(56) References Cited

U.S. PATENT DOCUMENTS 968,222 A * 8/1910 Williams ..... E05C 17/50 292/121
3,990,575 A * 11/1976 Egly ..... E05B 39/02 292/205
4,106,801 A * 8/1978 De Lima Castro Neto ..... G09F 3/20 292/307 R
4,331,257 A * 5/1982 Taschner ..... B65D 45/22 292/307 R
5,118,148 A * 6/1992 De Lima Castro Netto ..... G09F 3/20 292/307 R
5,125,697 A * 6/1992 Kahl ..... E05C 3/048 292/205
5,257,839 A * 11/1993 Nielsen ..... E05C 19/14 292/205
6,439,625 B1 * 8/2002 Schainholz ..... G09F 3/037 292/307 A

* cited by examiner

*Primary Examiner* — James N Smalley
(74) *Attorney, Agent, or Firm* — Michael Best & Friedrich LLP

(57) ABSTRACT

A tool case includes a base and a lid movably coupled to the base between an open position and a closed position. The lid and the base define an aperture when in the closed position. The tool case includes a latch coupled to the base and the lid to selectively restrict movement of the lid relative to the base from the closed position to the open position. The tool case includes a locking pin positioned in the aperture to secure the lid in the closed position.

20 Claims, 16 Drawing Sheets

LOCKING PIN FOR TOOL CASE

CROSS-REFERENCE TO RELATED APPLICATIONS

This application claims priority to U.S. Provisional Patent Application No. 63/509,438, filed on Jun. 21, 2023, the entire contents of which are incorporated herein by reference.

FIELD OF INVENTION

The present invention relates to tool cases, and more particularly to locking pins for tool cases.

SUMMARY

The present disclosure provides, in one aspect, a tool case including a base and a lid movably coupled to the base between an open position and a closed position. The lid and the base define an aperture when in the closed position. The tool case includes a latch coupled to the base and the lid to selectively restrict movement of the lid relative to the base from the closed position to the open position. The tool case includes a locking pin positioned in the aperture to secure the lid in the closed position.

The present disclosure provides, in one aspect, a locking pin for a tool case including a base, a lid movably coupled to the base between an open position and a closed position, and a latch coupled to the base and the lid to restrict movement of the lid relative to the base. The lid and the base define an aperture when in the closed position. The locking pin includes an elongated body configured to be inserted into the aperture of the tool case. The elongated body includes wings that are configured to flex inwardly as the locking pin is inserted into the aperture. The wings are configured to expand outwardly after the locking pin is fully inserted into the aperture to secure the lid in the closed position.

The present disclosure provides in one aspect, a method for securing a tool case. The method includes providing the tool case including a base, a lid movably coupled to the base between an open position and a closed position, and a latch coupled to the base and the lid to restrict movement of the lid relative to the base from the closed position to the open position. The lid and the base define an aperture when in the closed position. The method further includes inserting a locking pin into the aperture. The locking pin includes an elongated body that expands outwardly after the locking pin is fully inserted into the aperture to secure the lid in the closed position.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
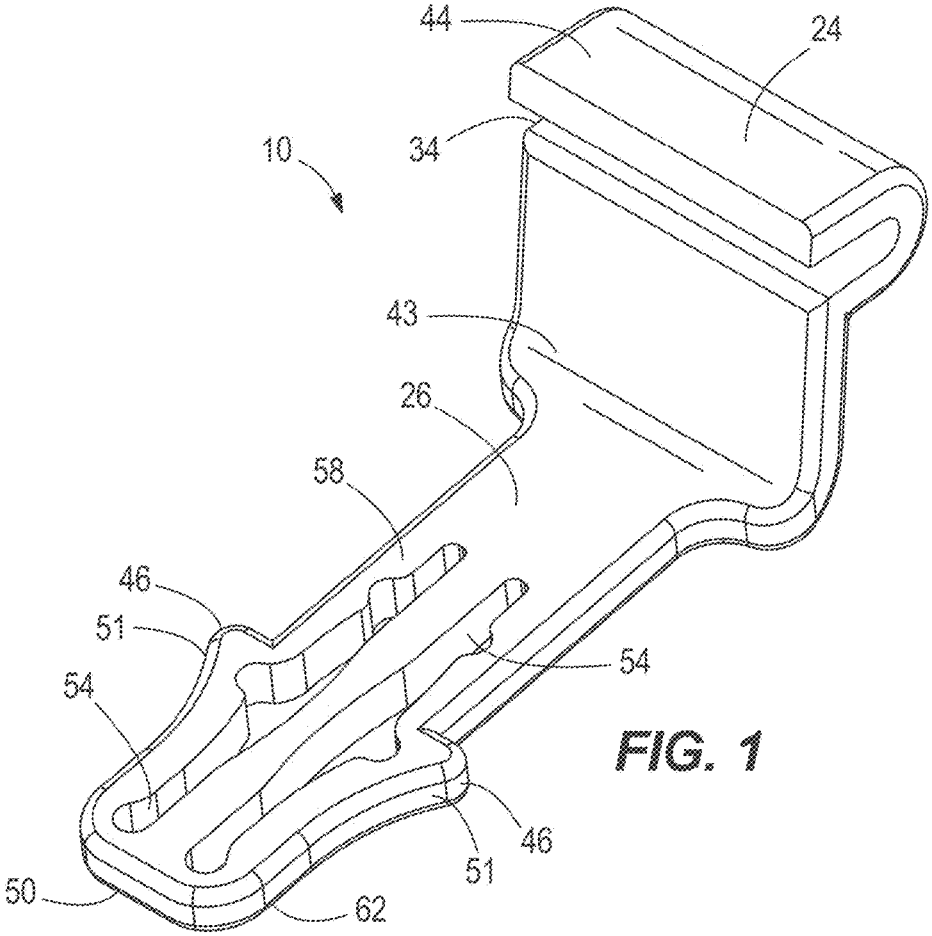
FIG. 1 is a perspective view of a locking pin according to an embodiment of the invention.
Figure 2:
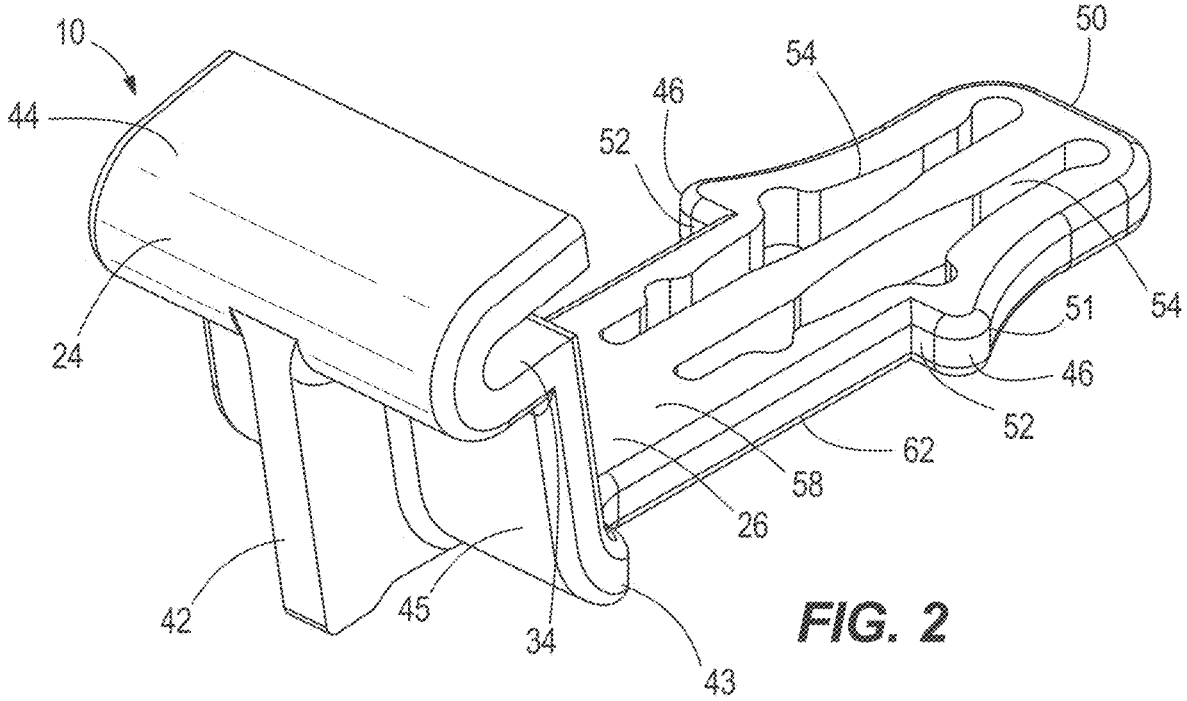
FIG. 2 is a rear perspective view of the locking pin of FIG. 1.
Figure 3:
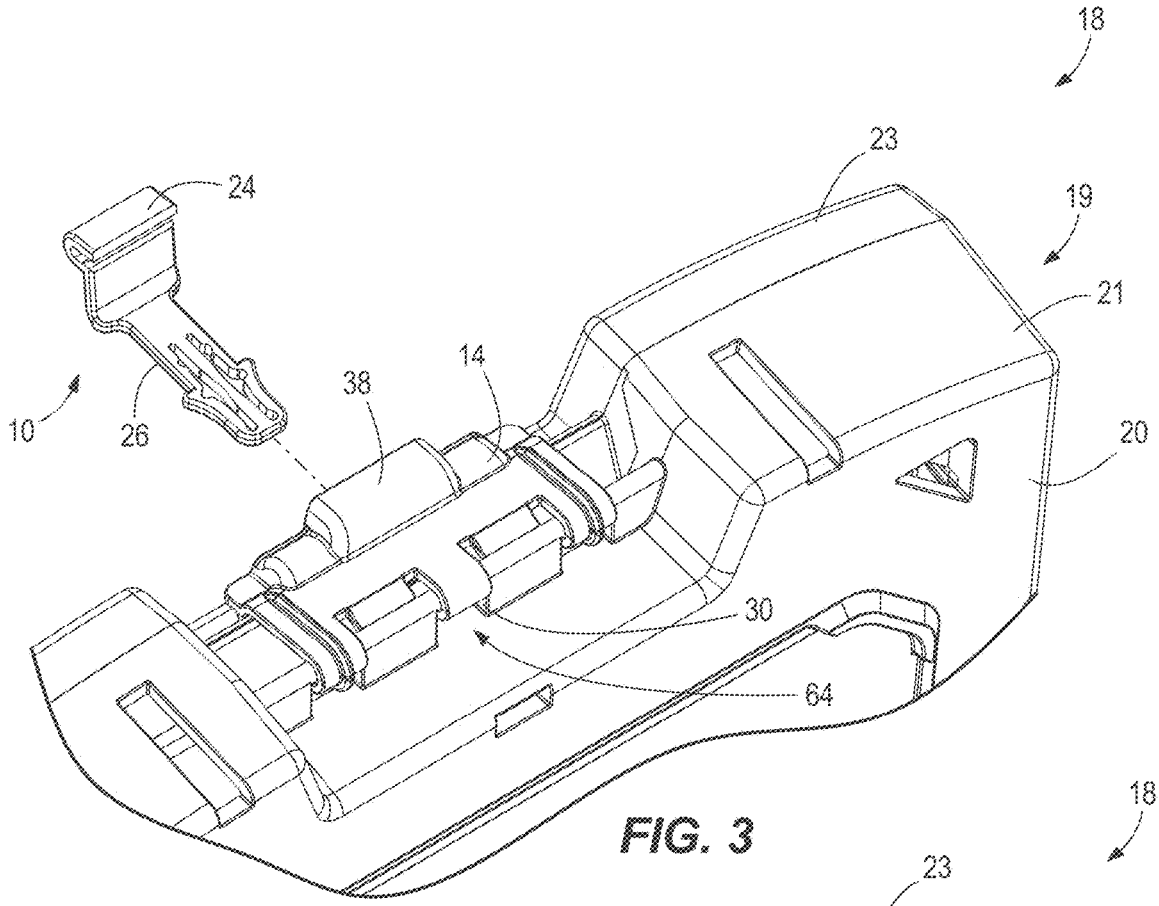
FIG. 3 is a perspective view of the locking pin of FIG. 1 being installed on a tool case including a latch.
Figure 4:
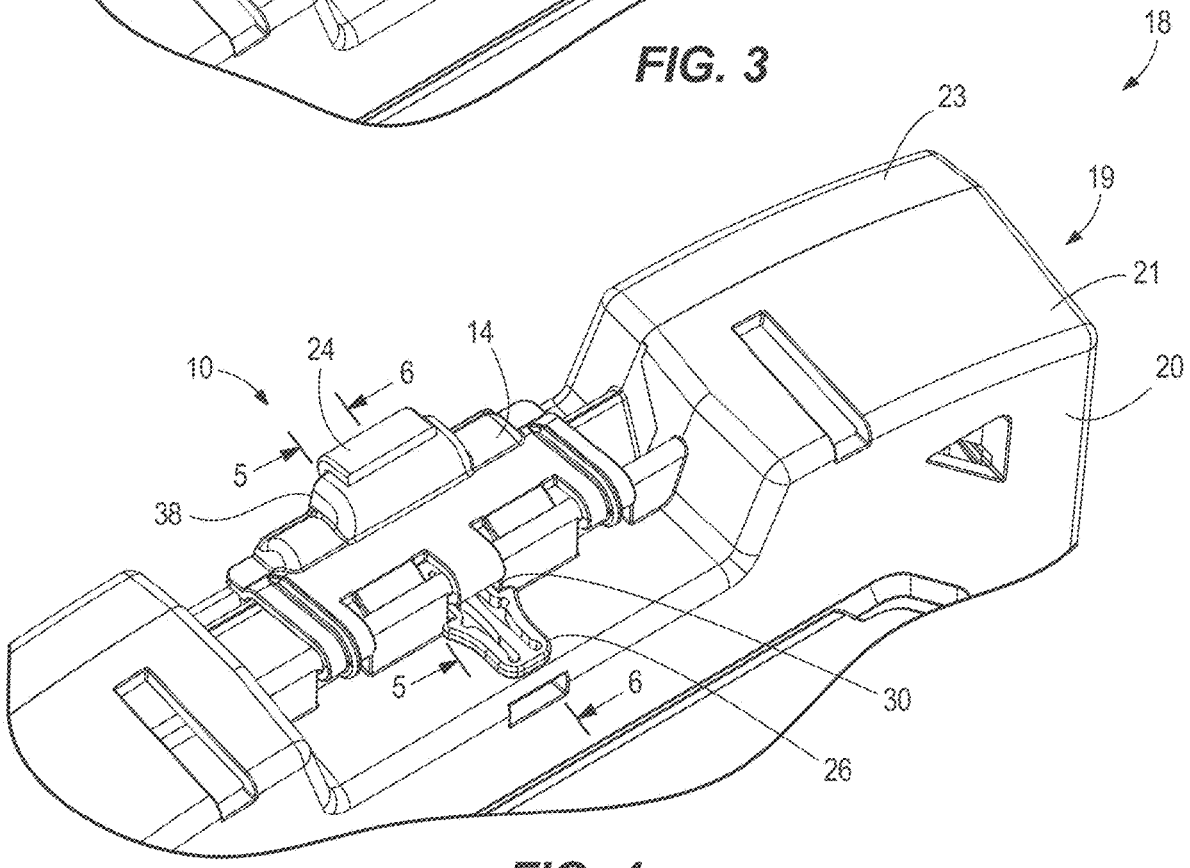
FIG. 4 is a perspective view of the locking pin of FIG. 1 installed on the tool case.

FIGS. 1-4 illustrate a locking pin 10. The locking pin 10 is configured to secure or lock a latch 14 of a case 18. The case 18 may be a tool case for a power tool, hand tool, or tool accessories. For example, the case 18 may store saw blades, hole saws, drill bits, driver bits, and the like. The case 18 includes a base 19 having a lower surface 20 with a plurality of base walls 21 extending from the lower surface 20. The lower surface 20 and base walls 21 define a cavity 22 (See FIG. 5). A lid 23 is movably coupled to the base 19 by a hinge (not shown). The lid 23 is moveable between an open position and a closed position to selectively enclose the cavity 22. FIGS. 3-4 illustrate the lid 23 in the closed position.

The locking pin 10 engages the latch 14 of the case 18 to inhibit or restrict a person from opening the lid 23 of the case 18 and accessing items inside the case 18. More particularly, the locking pin 10 inhibits or deters access to the case 18 when the case is on display in, for example, a store. A user may remove the locking pin 10 by cutting, snapping, or breaking the locking pin 10 after the case 18 and its contents are purchased. In other embodiments, the locking pin 10 may be used to inhibit access to other types of cases.

The illustrated locking pin 10 includes a clip 24 and an elongated body 26. The elongated body 26 may also be referred to as an elongated tongue or an elongated tab. A portion of the latch 14 is received by the clip 24 to prevent rotation of the latch 14. The latch 14 is rotatable between an open position and a closed position. The elongated body 26 is inserted into an aperture 30 of the case 18. The aperture 30 extends through the lid 23 and the base walls 21. The elongated body 26 is formed as an elastic body and is configured to flex when inserted into the aperture 30 of the case 18. The locking pin 10 is configured to secure or lock the latch 14 in the closed position to inhibit unauthorized access to the contents of the case 18.

FIG. 2 further illustrates the clip 24 of the locking pin 10. The clip 24 is integrally formed with the elongated body 26. The clip 24 extends in an upright orientation from the elongated body 26. In other embodiments, the clip 24 may extend approximately perpendicular from the elongated body 26. Still, in other embodiments, the clip 24 may extend obliquely from the elongated body 26.

The clip 24 defines a channel 34 extending across the clip 24. The channel 34 extends across a width of the clip 24. The channel 34 includes a shape that corresponds with a shape of a lip 38 of the latch 14. In some embodiments, the channel 34 includes a circular cross-sectional shape. In other embodiments, the channel 34 may include a square, rectangle, oval, or trapezoid cross-sectional shape.

With continued reference to FIG. 2, the clip 24 includes a rib 42. In the illustrated embodiment, the clip 24 includes one rib 42. In other embodiments, the clip 24 may include two, three, four, five, or any number of ribs 42. The rib 42 extends along a height or length of the clip 24. For example, the rib 42 extends from a first side 43 of the clip 24 (e.g., where the clip 24 is attached to the elongated body 26) toward a second side 44 of the clip 24 that is opposite the first side (e.g., where the channel 34 is formed). The rib 42 extends along a surface 45 of the clip 24 opposite from the elongated body 26. The rib 42 includes a rib width, where the rib width is less than the width of the clip 24. The rib 42 is configured to reinforce the clip 24. The rib width may be measured as a transverse width (e.g., width is measured across the rib 42).

As shown in FIGS. 1 and 2, the elongated body 26 is integrally formed with the clip 24. The clip 24 and the elongated body 26 are formed as one integral body or piece. The elongated body 26 extends in a horizontal orientation from the clip 24. The elongated body 26 includes a width, where the width is less than the width of the clip 24. The width of the elongated body 26 may be measured as a transverse width (e.g., width is measured across the elongated body 26).

With continued reference to FIGS. 1 and 2, the elongated body 26 is formed as an elastic body configured to flex when inserted into the case 18. In the illustrated embodiment, the elastic body includes wings 46 extending from the elongated body 26. The wings 46 are offset from an end 50 of the elongated body 26. In other embodiments, the elongated body 26 includes an elastic material or other structures configured to flex or yield under an applied force. In the illustrated embodiment, the elongated body 26 includes two wings 46. In other embodiments, the elongated body 26 may include two, three, four, or five wings 46. The wings 46 of the elongated body 26 extend beyond the width of the elongated body 26. In other words, a width measured between the wings is greater than the width of the elongated body 26. In the illustrated embodiment, each wing 46 includes a sloped surface 51 and an abutting surface 52. The sloped surfaces 51 face toward the end 50 of the elongated body 26. The sloped surfaces 51 engage the case 18 as the elongated body 26 is inserted into the aperture 30 to flex the wings 46 inwardly. The abutting surfaces 52 face away from the end 50 of the elongated body 26. The abutting surfaces 52 are abrupt shoulders that extend perpendicularly from the elongated body 26. The abutting surfaces 52 engage the case 18 after the elongated body 26 is fully inserted into the aperture 30 to inhibit the elongated body 26 from being pulled back through the aperture 30.

As shown in FIGS. 1 and 2, the elongated body 26 defines a slot 54. In the illustrated embodiment, the elongated body 26 defines two slots 54. In other embodiments, the elongated body 26 may define two, three, four, five, or any number of slots 54. The slots 54 extend from near the end 50 of the elongated body 26 towards the clip 24.

With continued reference to FIGS. 1 and 2, each slot 54 includes a volume bounded by a first, top surface 58 of the elongated body 26, and a second, bottom surface 62 of the elongated body 26. The slot 54 includes a variable volume in a direction extending from the end 50 of the elongated body toward the clip 24. The slot 54 includes a larger volume near or adjacent the wings 46 of the elongated body 26 compared to a volume of the slot 54 at a location distal the wings 46. The slots 54 of the elongated body 26 are configured to increase the flex or yield of the wings 46 under an applied force.

In operation, as shown in FIGS. 3 and 4, the locking pin 10 is inserted into the case 18. The latch 14 (e.g., the lip 38 of the latch 14) is engaged by the clip 24, and in particular the latch 14 is received by the channel 34 of the clip 24. The clip 24 prevents rotation of the latch 14. The elongated body 26 slides into the aperture 30 of the case 18 such that the wings 46 flex or yield as the elongated body 26 slides into the aperture 30. The wings 46 flex or yield from the engagement between the wings 46 and the inner walls 64 of the case 18. The wings 46 then rebound or expand when the wings 46 exit the aperture 30. The wings 46 include a wing width greater than a width of the aperture 30 (i.e., the width of the aperture 30 is measured between the inner walls 64 of the case 18) such that the wings 46 abut the case 18 when the locking pin 10 is installed onto the latch 14. The wings 46, thereby, cannot be pulled through the aperture 30 once the locking pin 10 is installed onto the case 18. The wings 46 prevent the locking pin 10 from being removed from the aperture 30.

Figure 5:
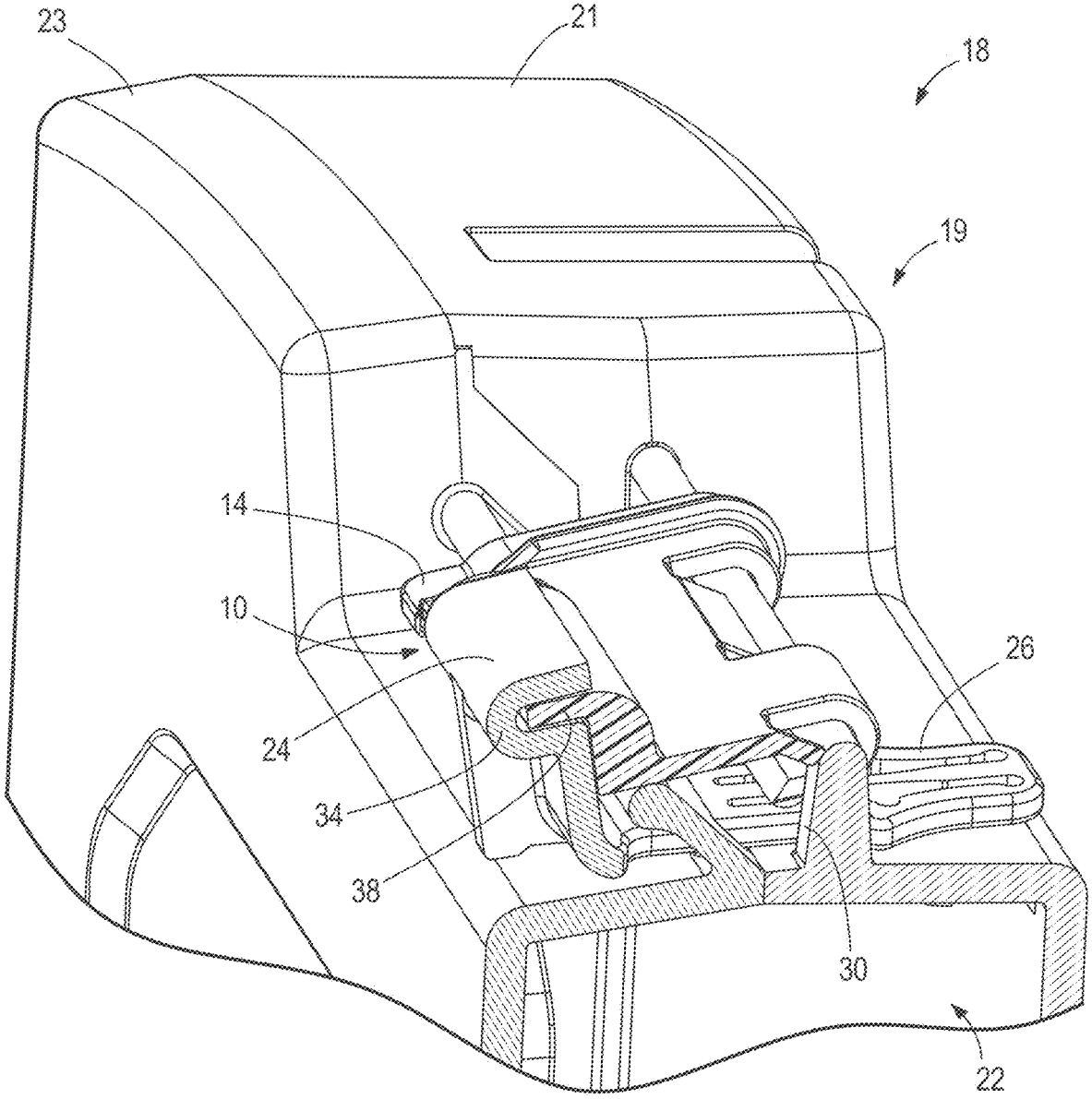
FIG. 5 is a cross-sectional view of the locking pin and the tool case taken along section line 5-5 of FIG. 4.
Figure 6:
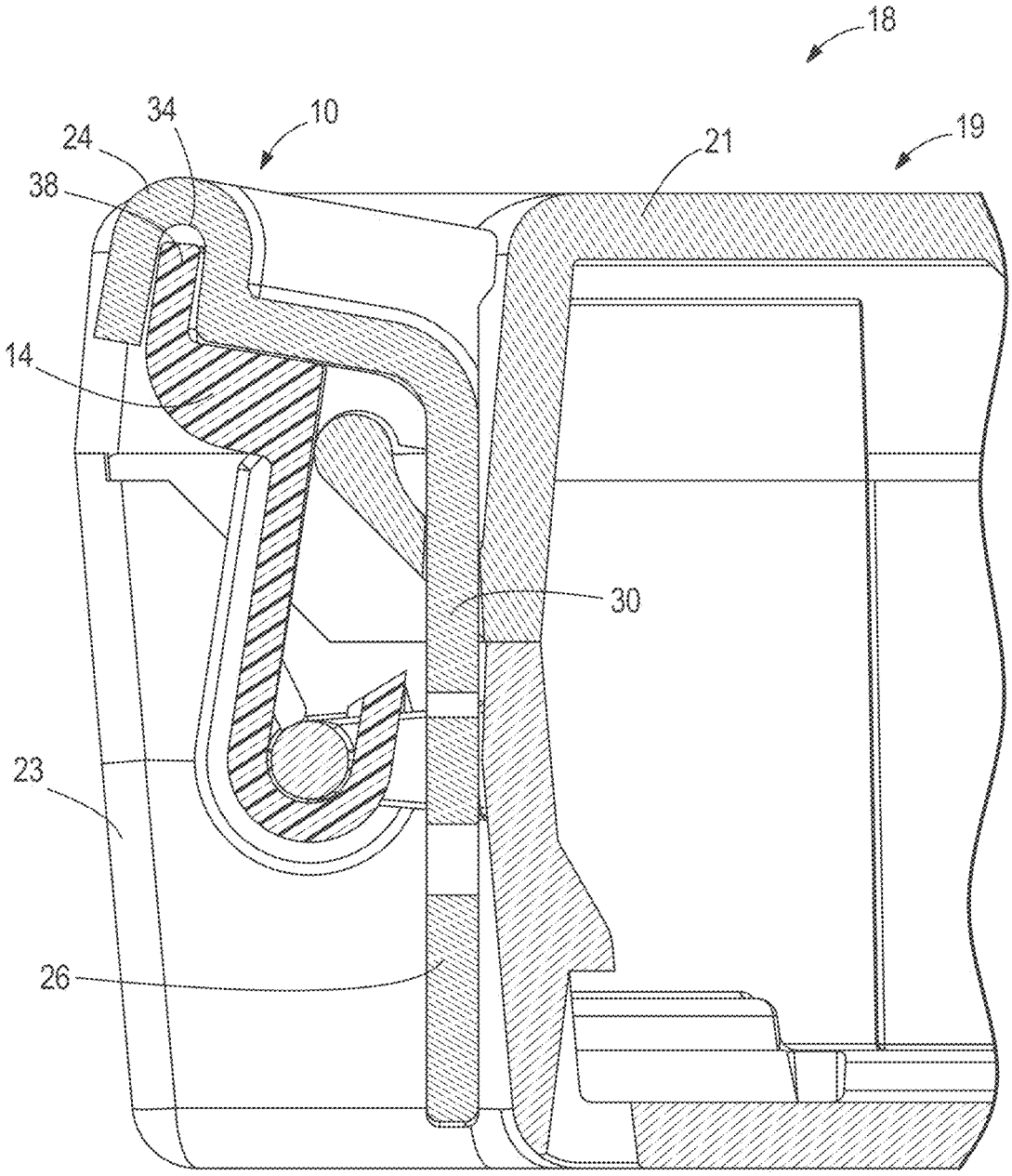
FIG. 6 is a cross-sectional view of the locking pin and the tool case taken along section line 6-6 of FIG. 4.

FIGS. 5 and 6 illustrate the locking pin 10 installed onto the latch 14 of the case 18. The clip 24 abuts the latch 14 such that the lip 38 on the latch 14 is engaged by the channel 34 of the clip 24. The elongated body 26 is received within the aperture 30 of the case 18. The elongated body 26 is below or underneath the latch 14. When installed, the elongated body 26 remains in the aperture 30, where the wings 46 abut a portion of the case 18.

Figure 7:
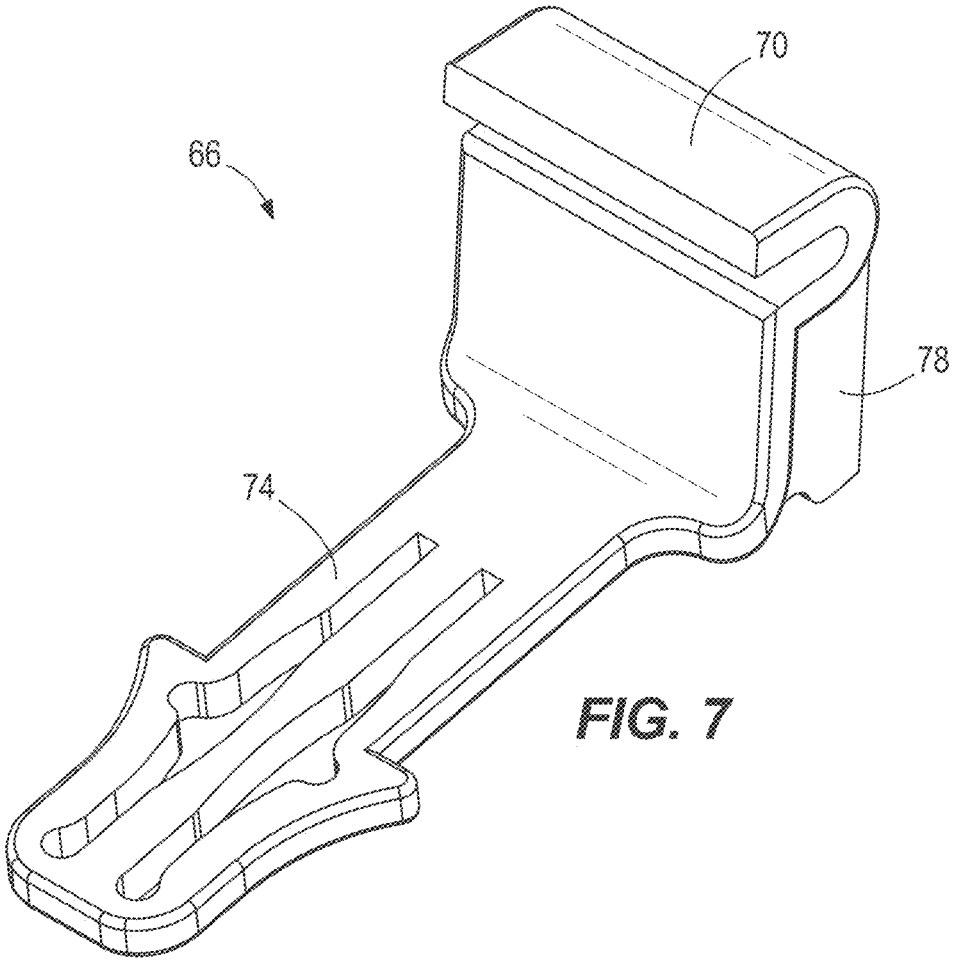
FIG. 7 is a perspective view of a locking pin according to an embodiment of the invention.
Figure 8:
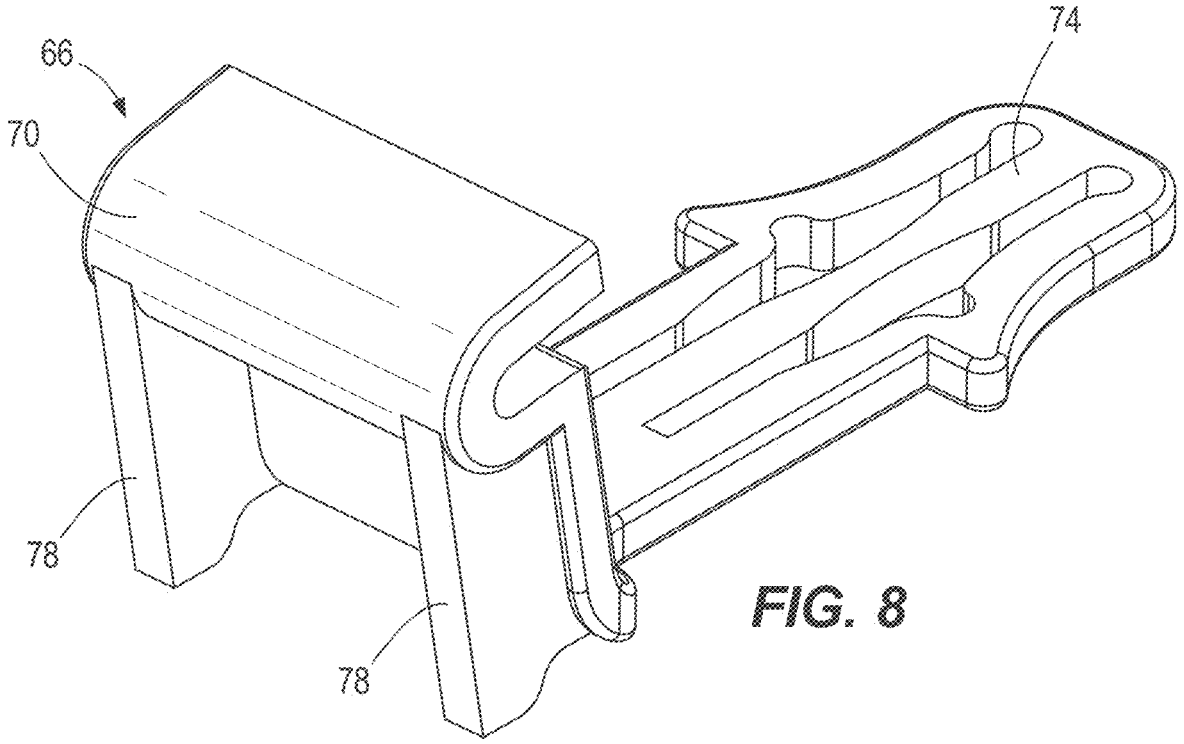
FIG. 8 is a rear perspective view of the locking pin of FIG. 7.

FIGS. 7 and 8 illustrate a locking pin 66 according to another embodiment of the invention. The locking pin 66 is similar to the locking pin 10 described above, and the following differences are explained below. The locking pin 66 includes a clip 70 and an elongated body 74. As shown in FIG. 8, the clip 70 includes ribs 78. In the illustrated embodiment, the clip 70 includes two ribs 78. The clip 70 includes more ribs 78 than the clip 24 described above. The ribs 78 are configured to reinforce the clip 70 when the locking pin 66 is installed onto the case 18.

Figure 9:
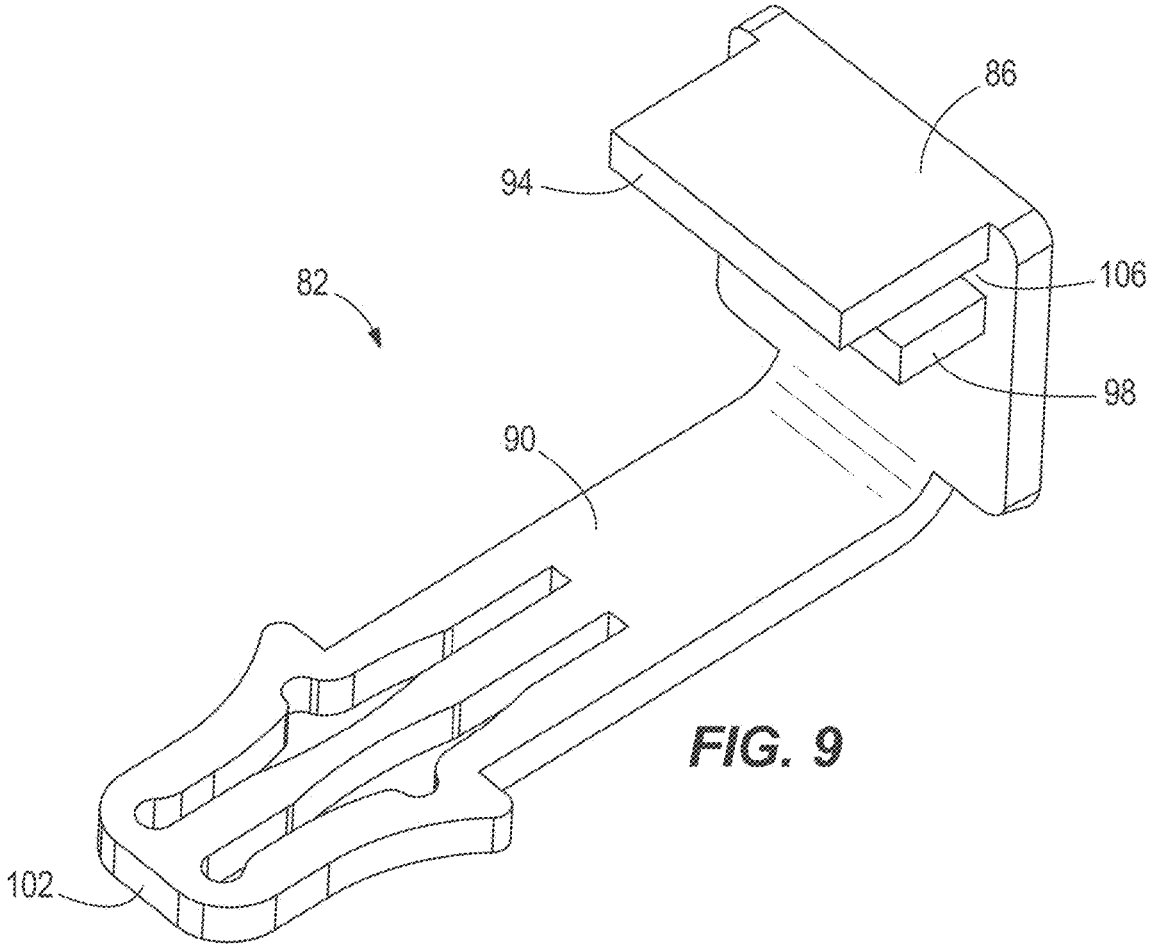
FIG. 9 is a perspective view of a locking pin according to an embodiment of the invention.
Figure 10:
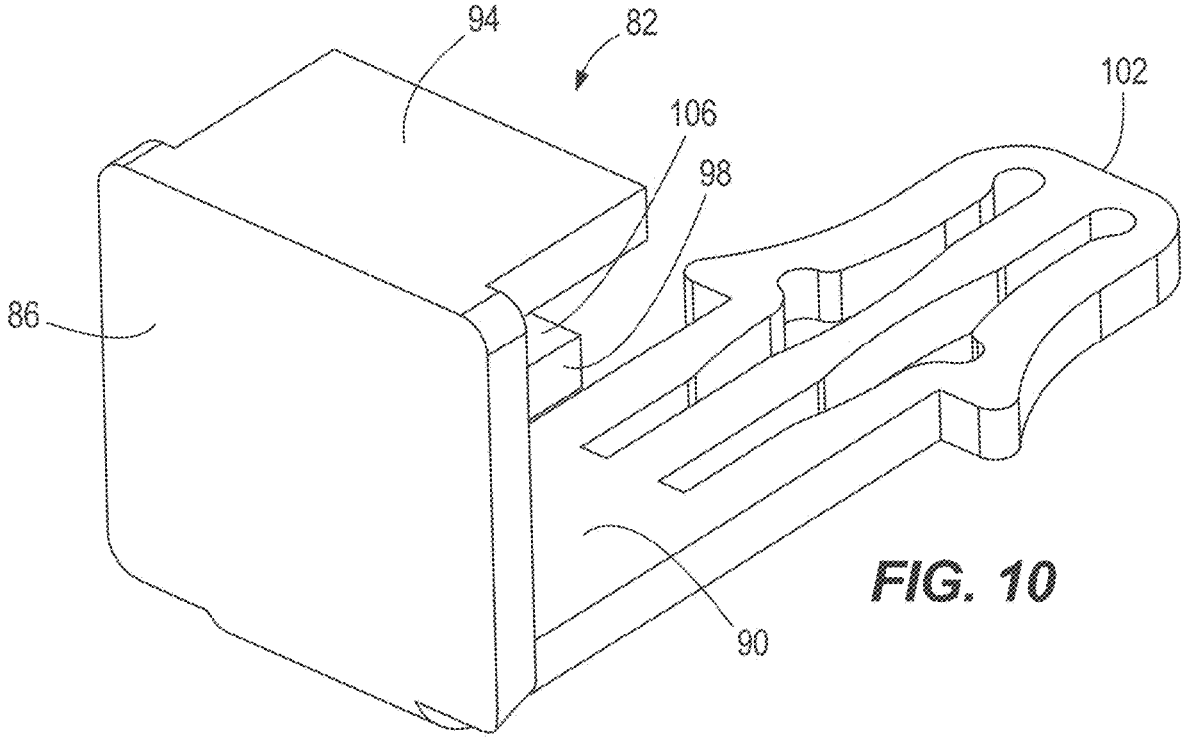
FIG. 10 is a rear perspective view of the locking pin of FIG. 9.

FIGS. 9 and 10 illustrate a locking pin 82 according to another embodiment of the invention. The locking pin 82 is similar to the locking pin 10 described above, and the following differences are explained below. The locking pin 82 includes a clip 86 and an elongated body 90. The clip 86 includes an overhang 94 and a protrusion 98. The overhang 94 extends a first distance from the clip 86 towards an end 102 of the elongated body 90. The protrusion 98 extends a second distance from the clip 86 towards the end 102 of the elongated body 26. The second distance is less than the first distance. The overhang 94 and the protrusion 98 define a channel 106 therebetween. The lip 38 of the latch 14 is engaged by the channel 106 of the clip 86 to prevent rotation of the latch 14.

Figure 11:
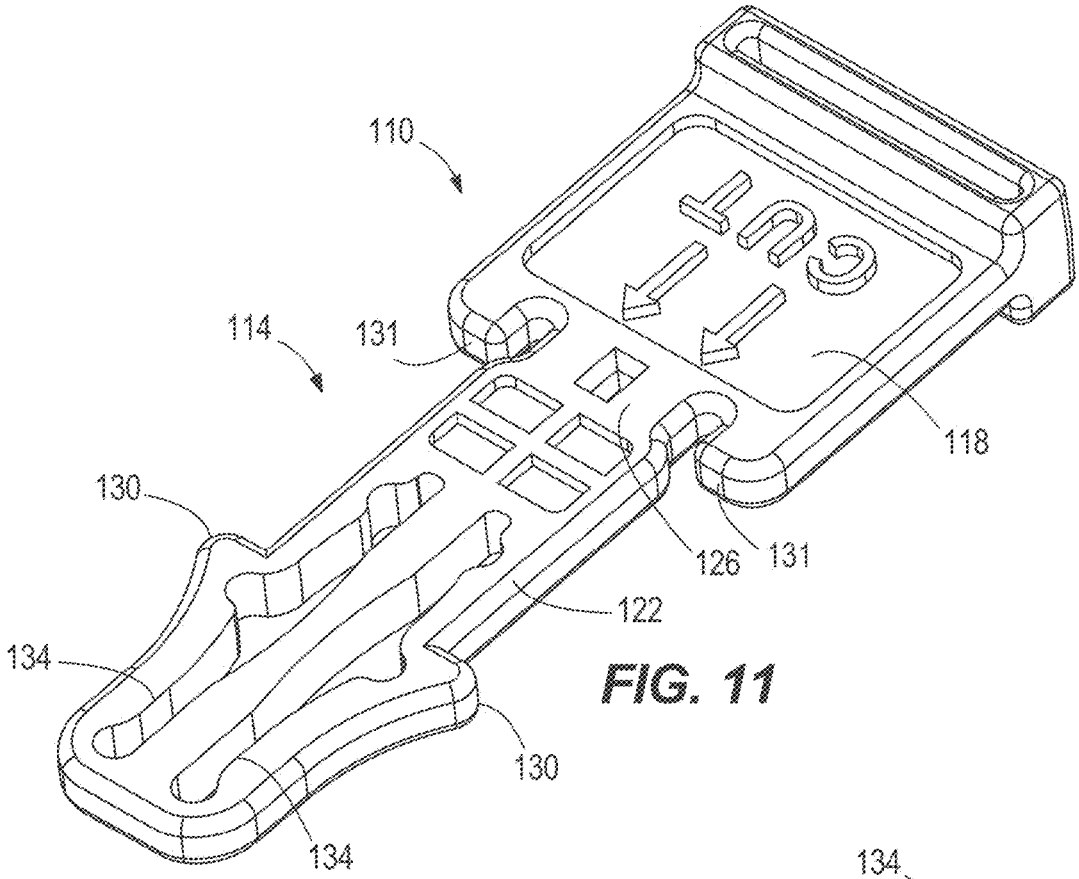
FIG. 11 is a perspective view a locking pin according to an embodiment of the invention.
Figure 12:
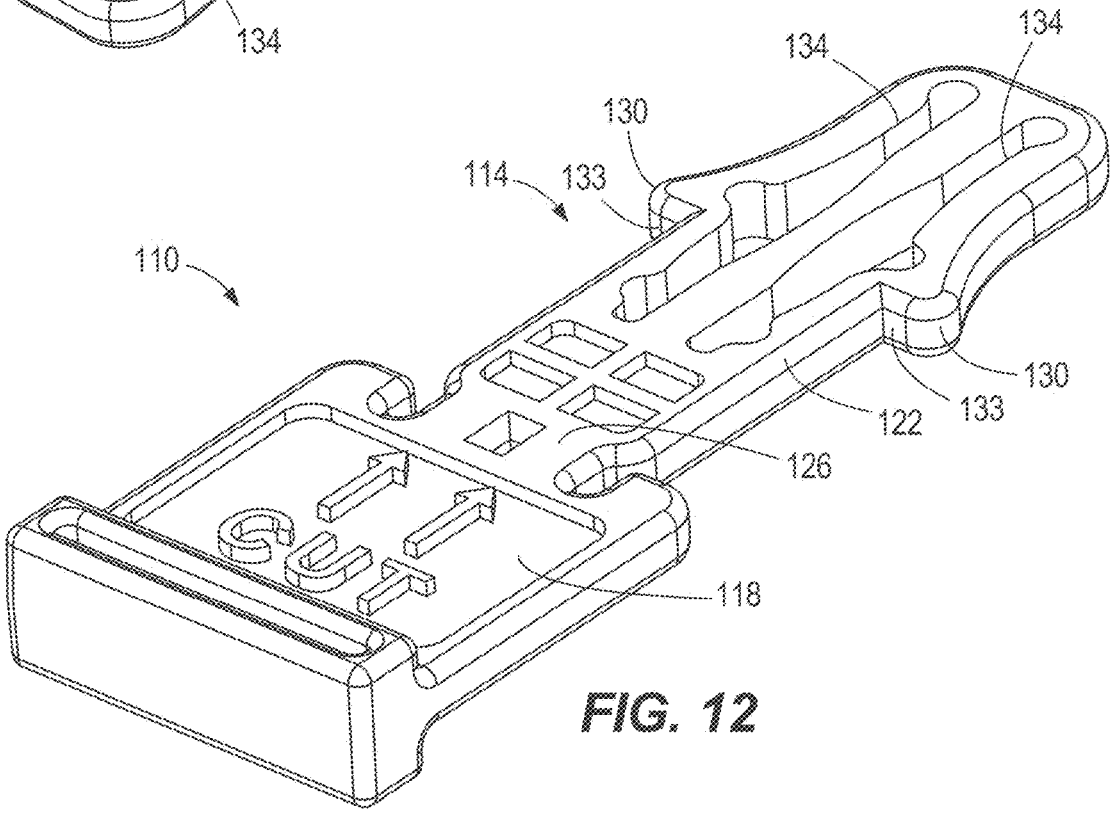
FIG. 12 is a rear perspective view of the locking pin of FIG. 11.

FIGS. 11 and 12 illustrate a locking pin 110 according to another embodiment of the invention. The locking pin 110 is similar to the locking pin 10 described above, and the following differences are explained below. The locking pin 110 includes an elongated body 114. The locking pin 110 does not include a clip as described above for the previous embodiments. The locking pin 110 is configured to secure the lid 23 on the case 18 to prevent unauthorized access to the contents of the case 18.

With reference to FIGS. 11 and 12, the elongated body 114 includes a tab 118 and an extension 122. The tab 118 includes a breakable body 126 that allows the tab 118 to be disconnected from the extension 122. The extension 122 includes wings 130 that extend outward from the extension 122. The extension 122 further defines slots 134 extending along a length of the extension 122. In the illustrated embodiment, the extension 122 defines two slots 134.

The tab 118 includes a first set of shoulders 131 perpendicular to the elongated body 114. The first set of shoulders 131 face towards the wings 130. The breakable body 126 is positioned between the first set of shoulders 131. The wings 130 include a second set of shoulders 133 perpendicular to the elongated body 114 and spaced apart from the first set of shoulders 131. The second set of shoulders 133 face towards the tab 118.

Figure 13:
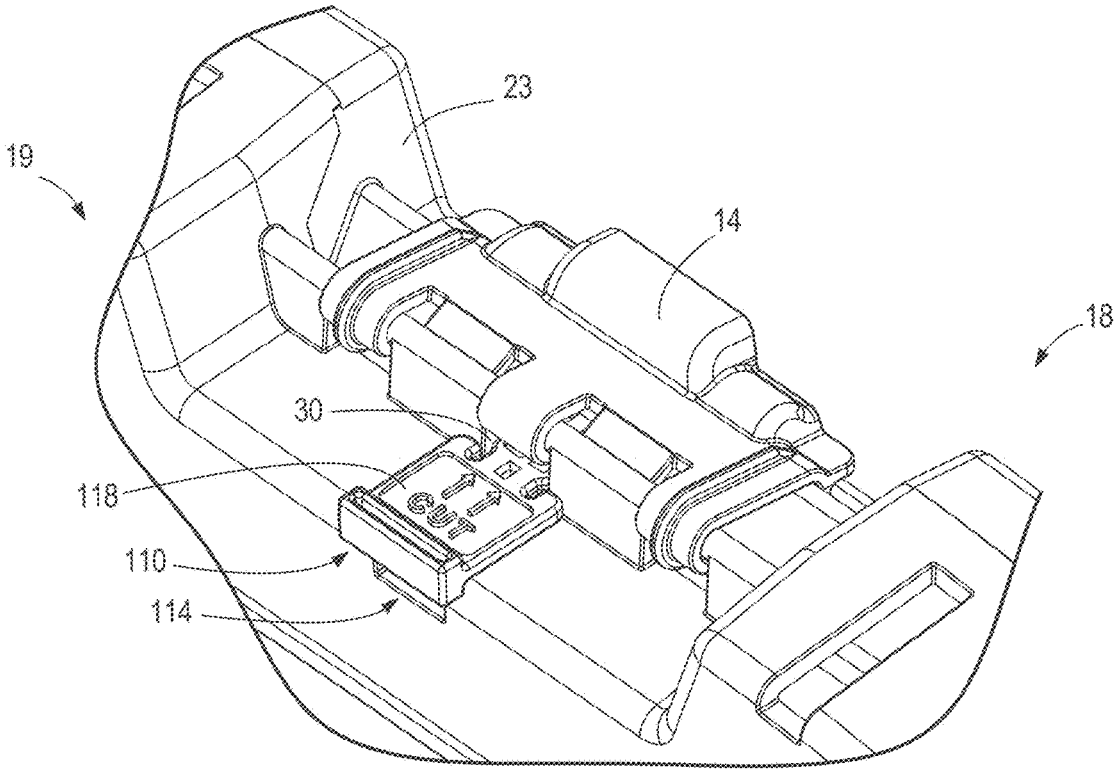
FIG. 13 is a perspective view of the locking pin of FIG. 11 installed on a tool case including a latch.
Figure 14:
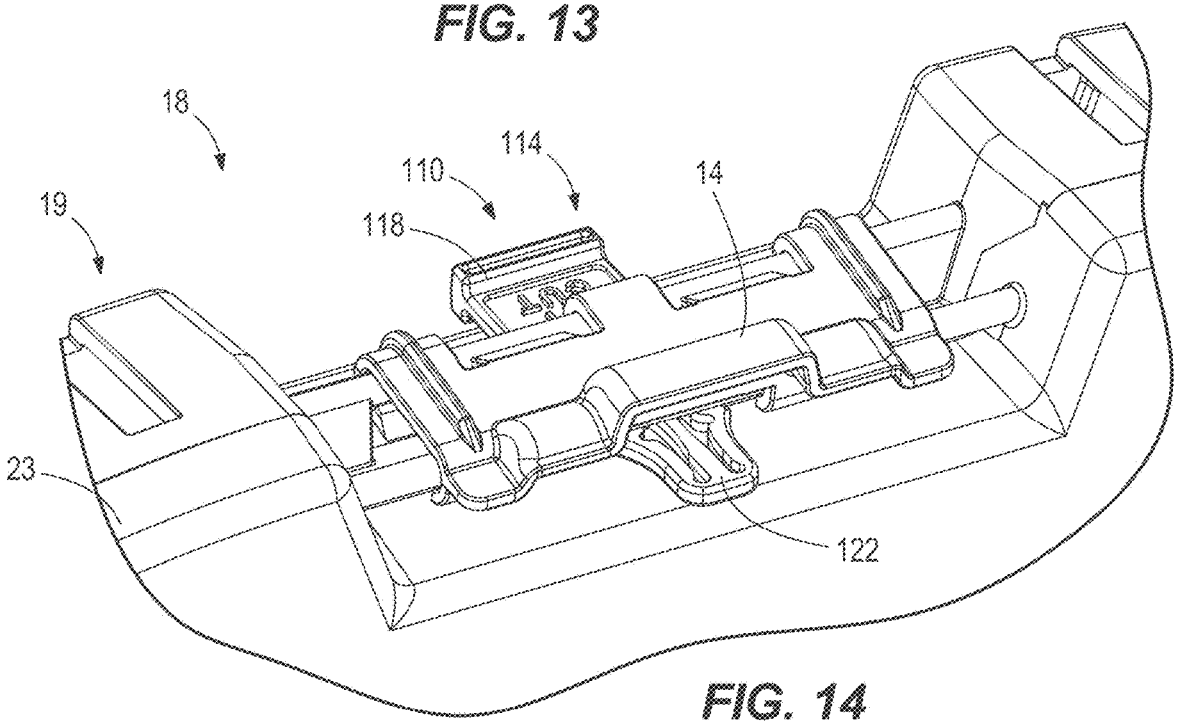
FIG. 14 is another perspective view of the locking pin of FIG. 11 installed on the tool case.
Figure 15:
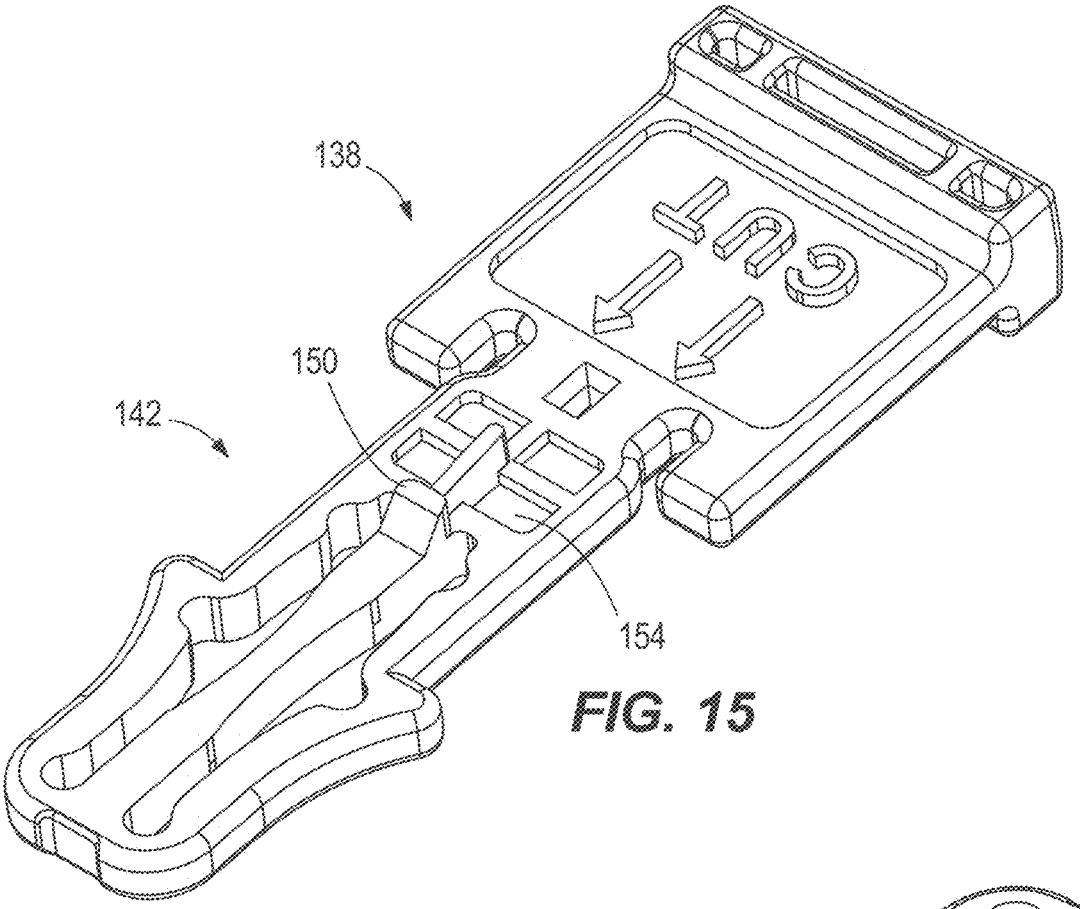
FIG. 15 is a perspective view of a locking pin according to an embodiment of the invention.
Figure 16:
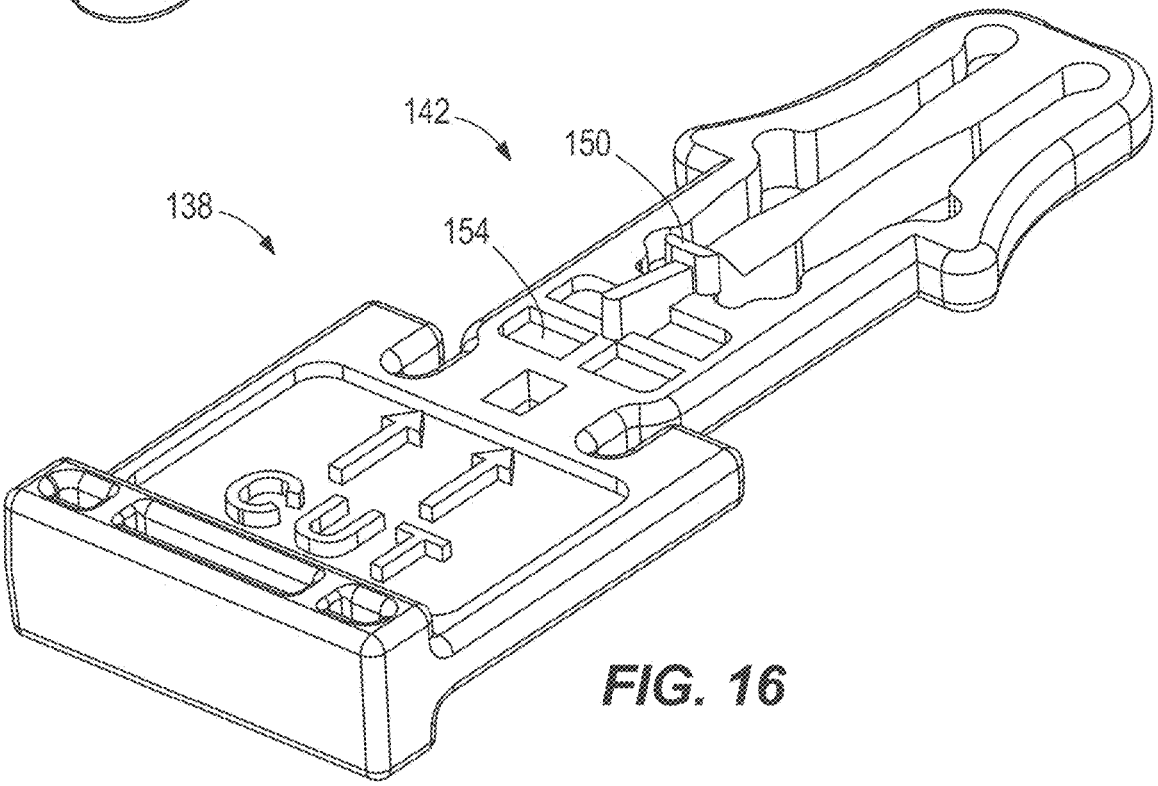
FIG. 16 is a rear perspective view of the locking pin of FIG. 15.

FIGS. 13 and 14 illustrate the locking pin 110 installed onto the case 18. The elongated body 114 slides into the aperture 30 of the case 18 such that the wings 130 flex or yield as the elongated body 114 slides into the aperture 30. The wings 46 flex or yield from the engagement between the wings 46 and the inner walls 64 of the case 18. The wings 130 then rebound or expand as the wings 130 exit the aperture 30. The first set of shoulders 131 are configured to engage a portion of the base 19 and the second set of shoulders 133 are configured to engage a portion of the lid 23. The portion of the base 19 and the lid 23 are captured between the shoulders 131, 133. The wings 130, thereby, cannot be pulled through the aperture 30 once the locking pin 110 is installed onto the case 18. The wings 130 (e.g., the shoulders 131, 133) prevent the locking pin 110 from being removed from the aperture 30 of the case 18. The locking pin 110 is not directly coupled with the latch 14. As such, the latch 14 may be rotated while the locking pin 110 is installed onto the case 18. The locking pin 110, however, still prevents the lid 23 of the case 18 from being opened. When a user wants to open the case 18, the user cuts or breaks the breakable body 126 of the locking pin 110 to allow the locking pin 110 to be removed from the case 18.

FIGS. 15-17B illustrate a locking pin 138 according to another embodiment of the invention. The locking pin 138 is similar to the locking pin 110 described above, and the following differences are explained below. The locking pin 138 includes an elongated body 142. The locking pin 138 does not include a clip as described above for the previous embodiments.

Figure 17A:
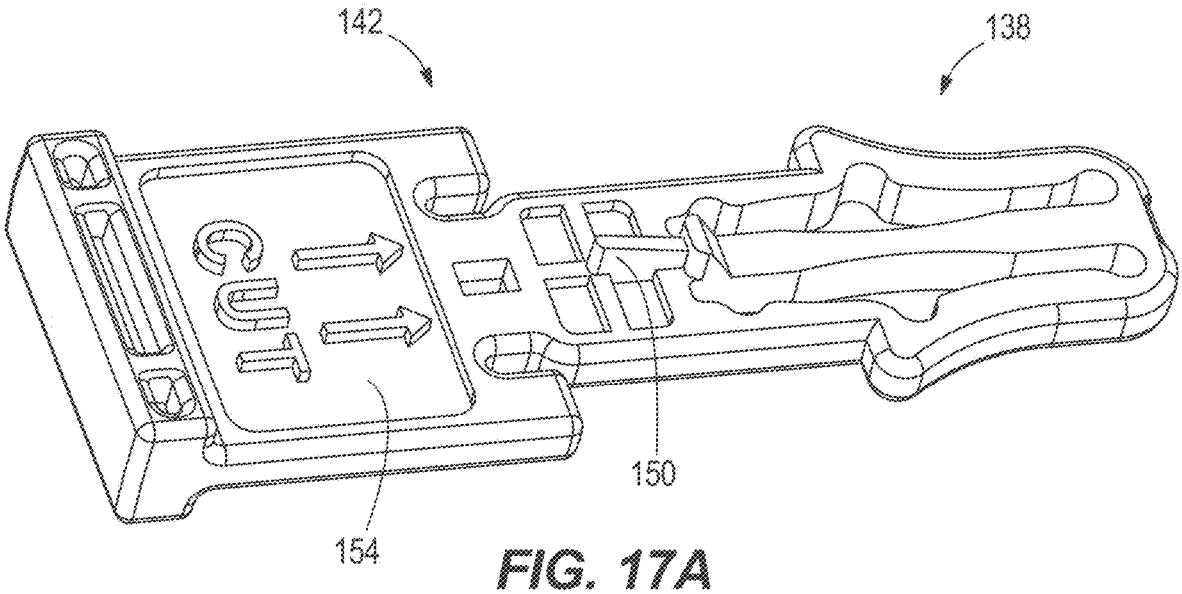
FIG. 17A is another perspective view of the locking pin of FIG. 15.
Figure 17B:
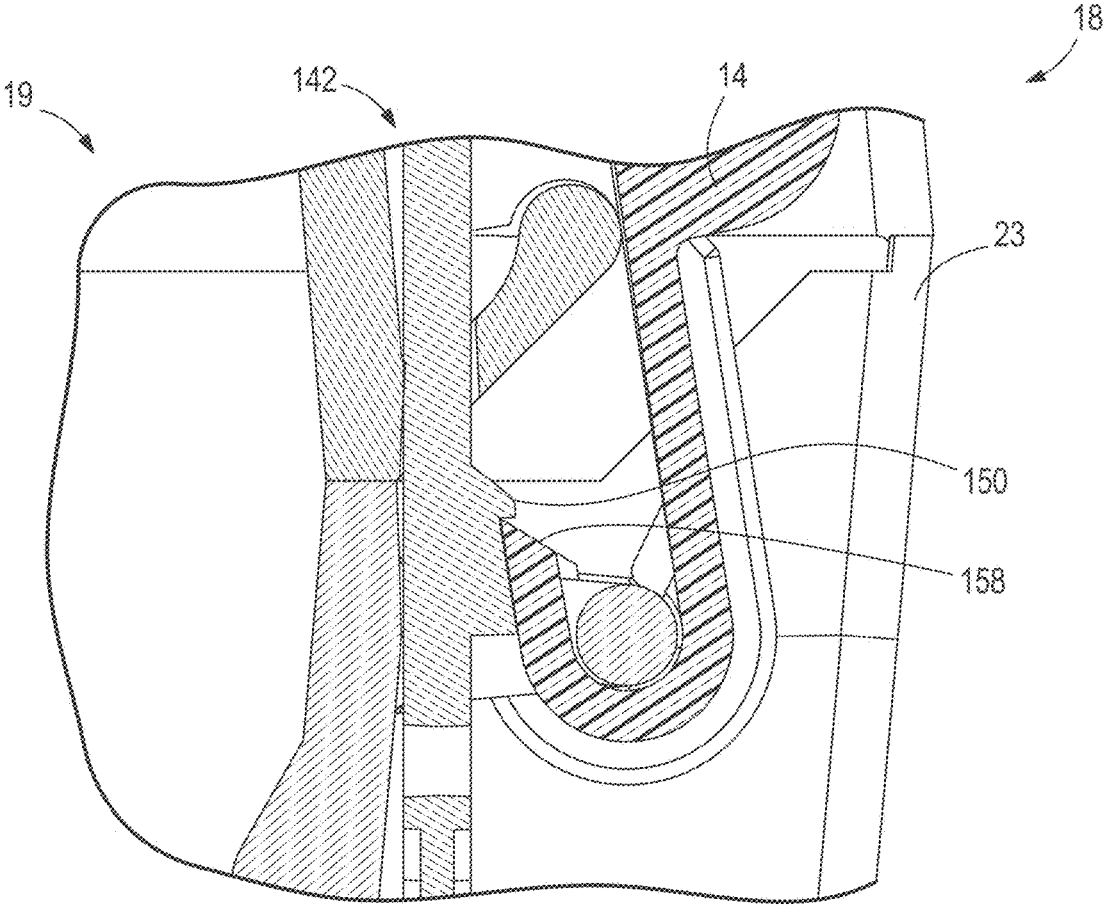
FIG. 17B is a cross-sectional view of the locking pin of FIG. 15 installed on a tool case including a latch.

With reference to FIGS. 17A and 17B, the locking pin 138 further includes a hook 150 extending from a top surface 154 of the elongated body 142. The hook 150 may also be referred to as a latch feature or a protrusion. When the locking pin 138 is installed on the case 18, the hook 150 contacts the latch 14 to prevent rotation of the latch 14. For example, as illustrated in FIG. 17B, the hook 150 engages an end 158 of the latch 14 to prevent rotation of the latch 14.

Figure 18:
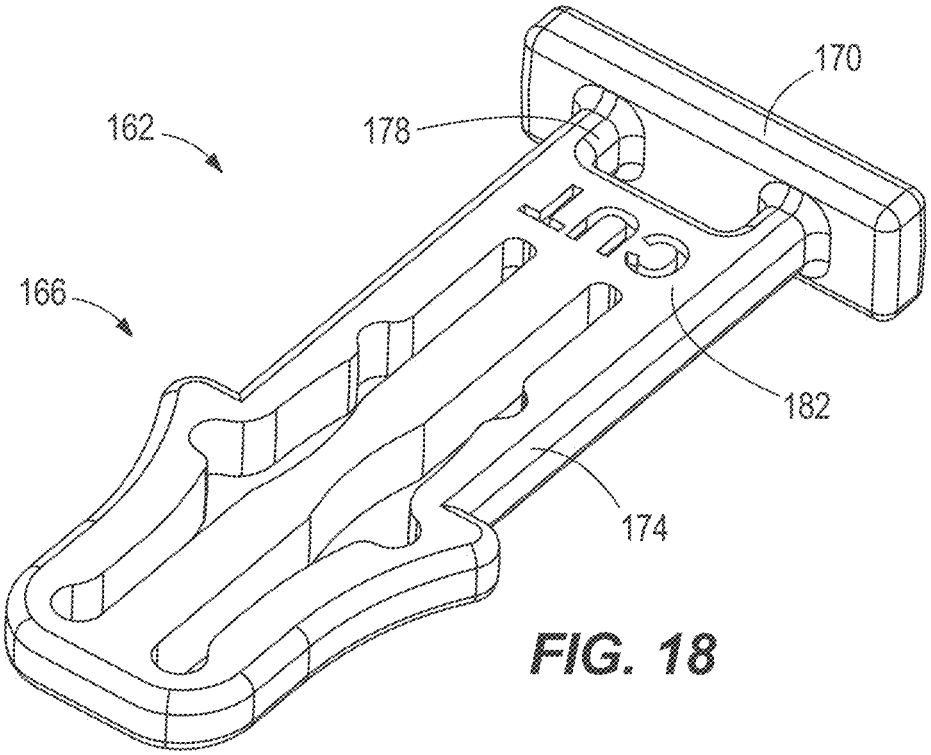
FIG. 18 is a perspective view of a locking pin according to an embodiment of the invention.
Figure 19:
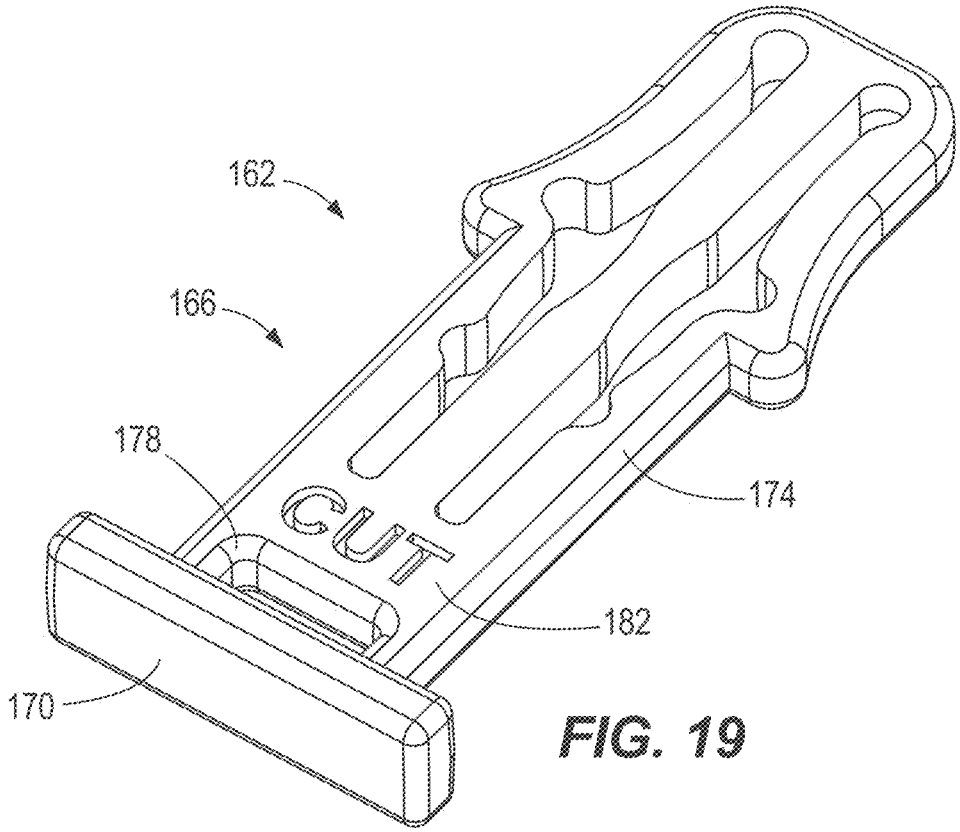
FIG. 19 is a rear perspective view of the locking pin of FIG. 18.

FIGS. 18 and 19 illustrate a locking pin 162 according to another embodiment of the invention. The locking pin 162 is similar to the locking pin 110 described above, and the following differences are explained below. The locking pin 162 includes an elongated body 166. The locking pin 162 does not include a clip as described above for the previous embodiments.

With reference to FIGS. 18 and 19, the elongated body 166 includes a tab 170 and an extension 174. The tab 170 and the extension 174 define a recess 178 therebetween. The elongated body 166 includes a breakable body 182 positioned between the tab 170 and the extension 174. The breakable body 182 is adjacent the recess 178 and allows the elongated body 166 to be disconnected or broken. The breakable body 182 allows the elongated body 166 to be removed from the case 18 to access the contents of the case 18.

Figure 20:
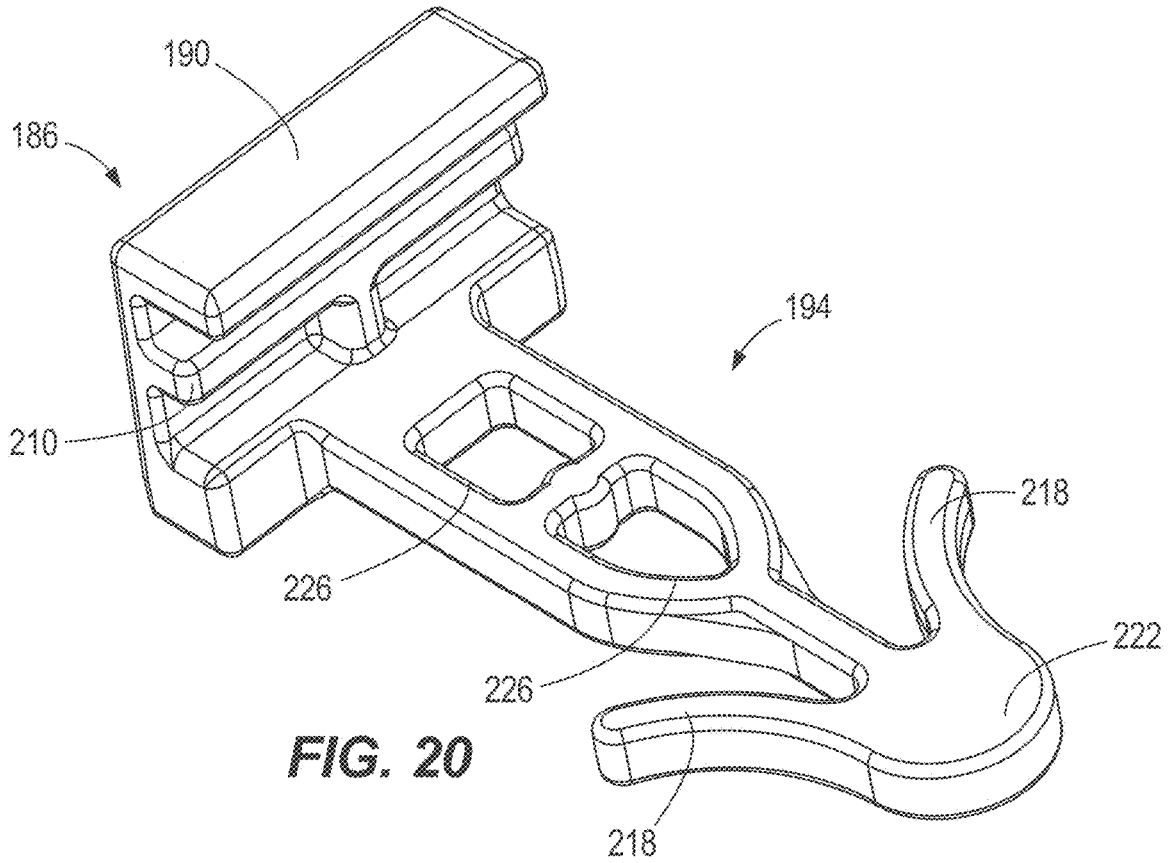
FIG. 20 is a perspective view of a locking pin according to an embodiment of the invention.
Figure 21:
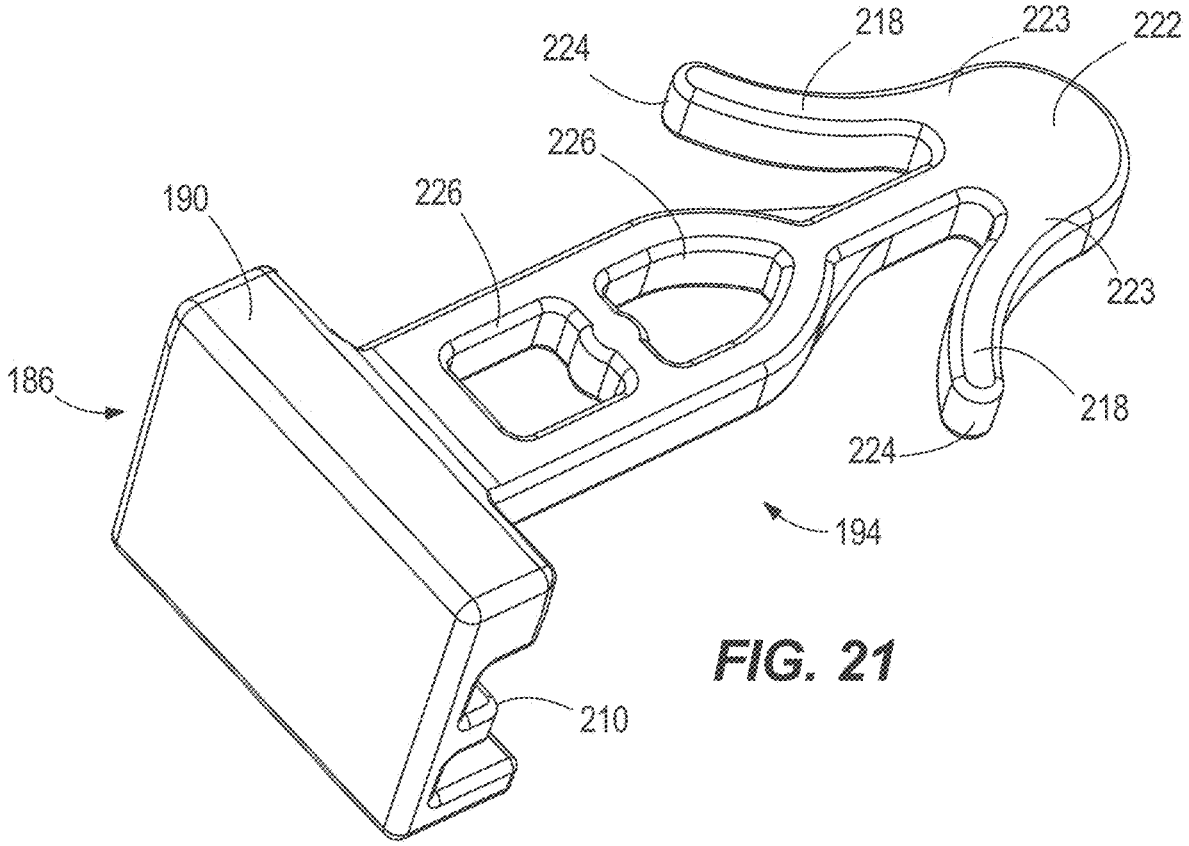
FIG. 21 is a rear perspective view of the locking pin of FIG. 20.
Figure 22:
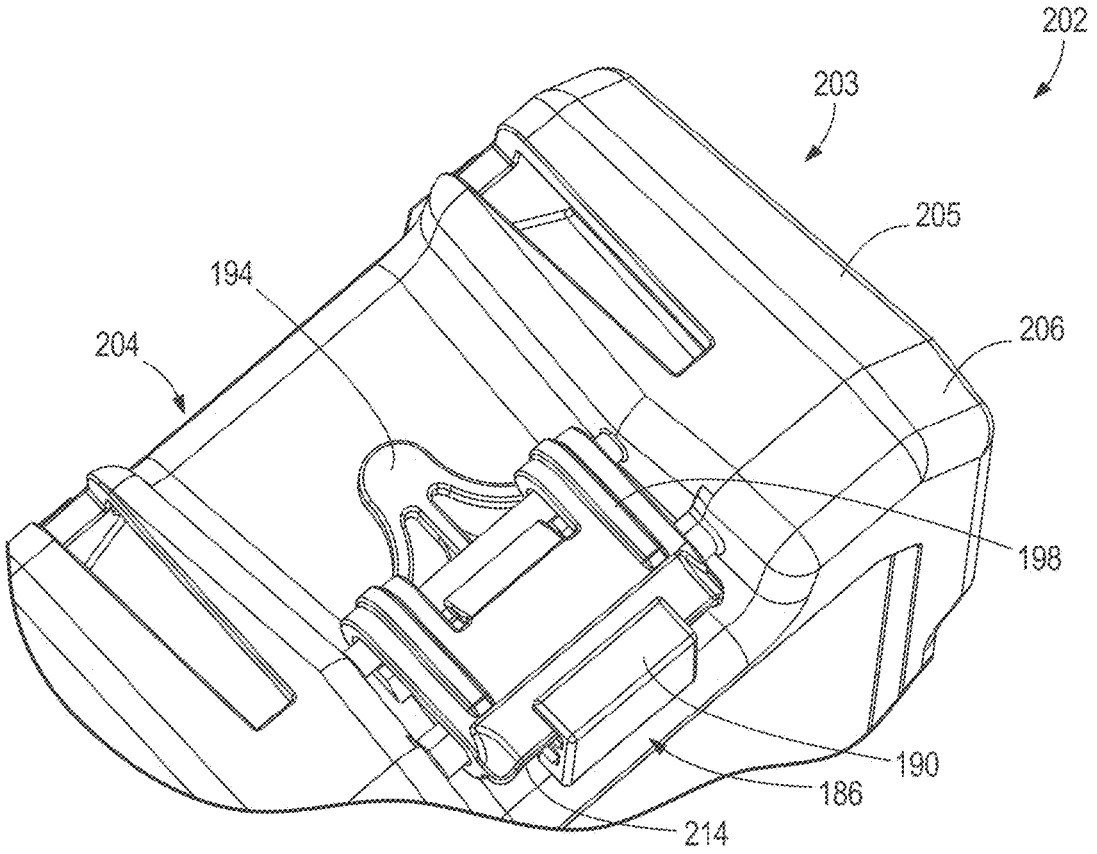
FIG. 22 is a perspective view of the locking pin of FIG. 20 installed on a tool case including a latch.
Figure 23:
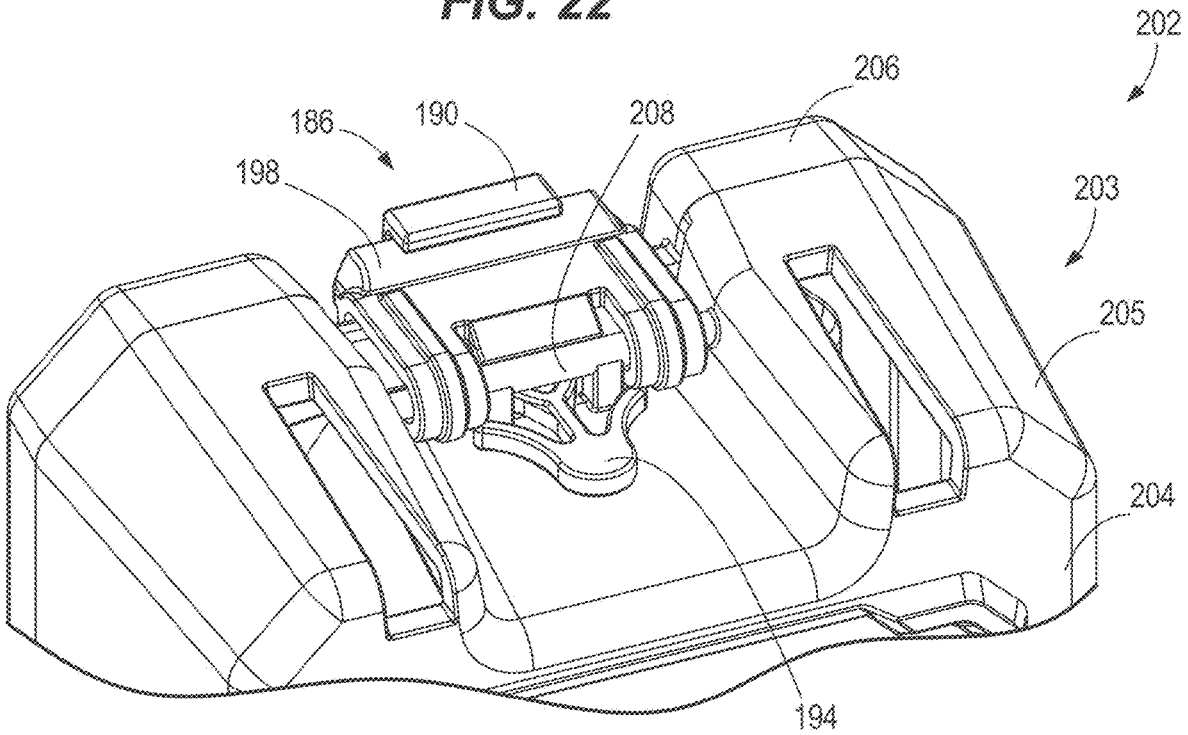
FIG. 23 is another perspective view of the locking pin of FIG. 20 installed on the tool case.

FIGS. 20 and 21 illustrate a locking pin 186 according to another embodiment of the invention. The locking pin 186 is configured to lock a latch 198 of a case 202 (FIGS. 22 and 23). The case 202 includes a base 203 having a lower surface 204 with a plurality of base walls 205 extending from the lower surface 204. The lower surface 204 and the base walls 205 define a cavity (not shown). A lid 206 is movably coupled to the base 203 by a hinge (not shown). The lid 206 is moveable between an open position and a closed position to selectively enclose the cavity. FIGS. 22-23 illustrate the lid 206 in the closed position.

The locking pin 186 includes a clip 190 and an elongated body 194. A portion of the latch 198 is received by the clip 190 to prevent rotation of the latch 198. The latch 198 is rotatable between an open position and a closed position. The elongated body 194 is inserted into an aperture 208 of the case 202. The aperture 208 extends through the lid 206 and the base walls 205. The elongated body 194 is formed as an elastic body and is configured to flex when inserted into the aperture 208 of the case 202. The locking pin 186 is configured to lock the latch 198 in the closed position, thereby inhibiting unauthorized access to the contents of the case 202. The locking pin 186 may be used with smaller cases or display cases. The illustrated case 202 is smaller compared to the case 18 described above. The illustrated latch 198 is also smaller compared to the latch 14 described above.

With continued reference to FIGS. 20 and 21, the clip 190 is integrally formed with the elongated body 194. The clip 190 extends in an upright orientation from the elongated body 194. In other embodiments, the clip 190 may extend approximately perpendicular to the elongated body 194. Still, in other embodiments, the clip 190 may extend obliquely from the elongated body 194. The clip 190 defines a channel 210 extending across the clip 190. The channel 210 extends along a width of the clip 190. The channel 210 includes a shape that corresponds with a shape of a lip 214 of the latch 198. In the illustrated embodiment, the channel 210 includes a rectangular cross-sectional shape. In other embodiments, the channel 210 includes a circular, square, oval, or trapezoid cross-sectional shape.

As shown in FIGS. 20 and 21, the locking pin 186 is formed as one integral body or piece, where the elongated body 194 is integrally formed with the clip 190. The elongated body 194 extends in a horizontal orientation from the clip 190. The elongated body 194 includes a width, where the width is less than the width of the clip 190. The width of the elongated body 194 may be measured as a transverse width (i.e., the width is measured across the elongated body 194).

With continued reference to FIGS. 20 and 21, the elongated body 194 is formed as an elastic body configured to flex when inserted into the case 202. In the illustrated embodiment, the elastic body includes wings 218 that extend outwardly from the elongated body 194. In the illustrated embodiment, the elongated body 194 includes two wings 218. The wings 218 extend from an end 222 of the elongated body 194 rearward towards the clip 190. In the illustrated embodiment, each wing 218 is a cantilevered arm having a first or proximal end 223 connected to the elongated body 194 and a second or distal end 224 that is a free end. The wings 218 include an arrowhead shape or a curved shape.

As shown in FIGS. 20 and 21, the elongated body 194 defines an aperture 226. In the illustrated embodiment, the elongated body 194 defines two apertures 226. In other embodiments, the elongated body 194 defines one, two, three, four, five, or any number of apertures 226.

FIGS. 22 and 23 illustrate the locking pin 186 installed onto the case 202. The latch 198 (e.g., the lip 214 of the latch 198) is engaged by the clip 190, and in particular the latch 198 is engaged by the channel 210 of the clip 190. The clip 190 prevents rotation of the latch 198. The elongated body 194 slides into the aperture 208 of the case 202 such that the wings 218 flex or yield as the elongated body 194 slides into the aperture 208. The wings 218 flex or yield from the engagement between the wings 218 and the inner walls 64 of the case 18. The wings 218 then rebound or expand when the wings 218 exit the aperture 208. The distal ends 224 of the wings 218 engage a portion of the base 203. In particular, the distal ends 224 of the wings 218 form abrupt shoulders that engage the base 203. The wings 218, thereby, cannot be pulled through the aperture 208 once the locking pin 186 is installed onto the case 202. The wings 218 prevent the locking pin 186 from being removed from the aperture 208 of the case 202. The locking pin 186 prevents rotation of the latch 198 thereby inhibiting the lid 206 of the case 202 from being opened (e.g., two case halves are inhibited from being open). When a user wants to open the case 202, the user cuts or breaks a breakable body of the locking pin 186 to allow the locking pin 186 to be removed from the case 202.

Figure 24:
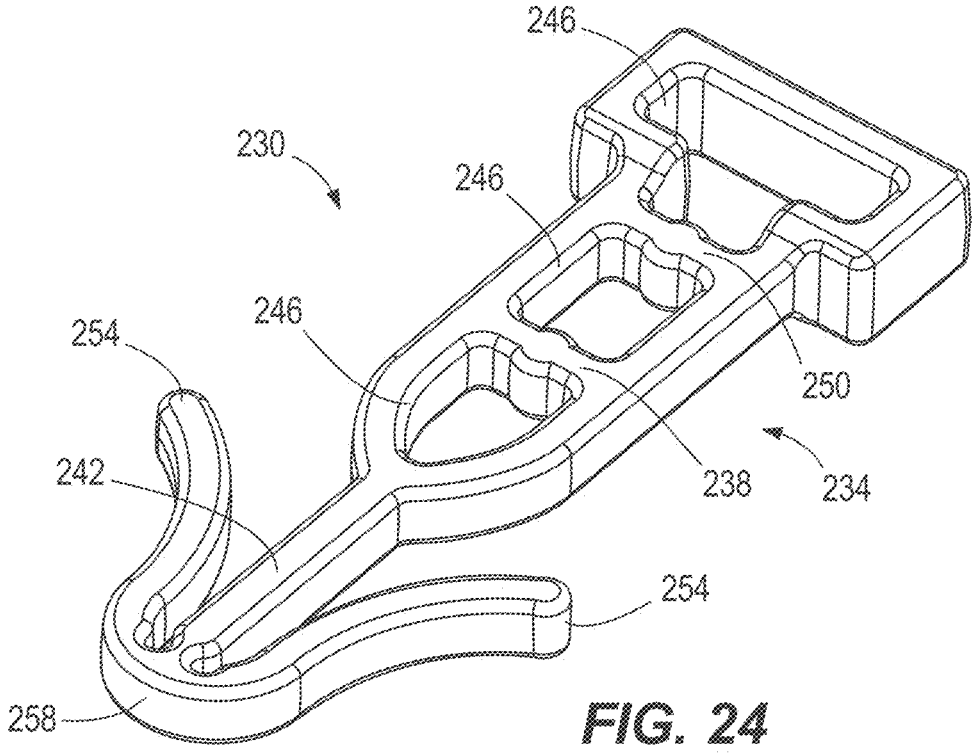
FIG. 24 is a perspective view of a locking pin according to an embodiment of the invention.
Figure 25:
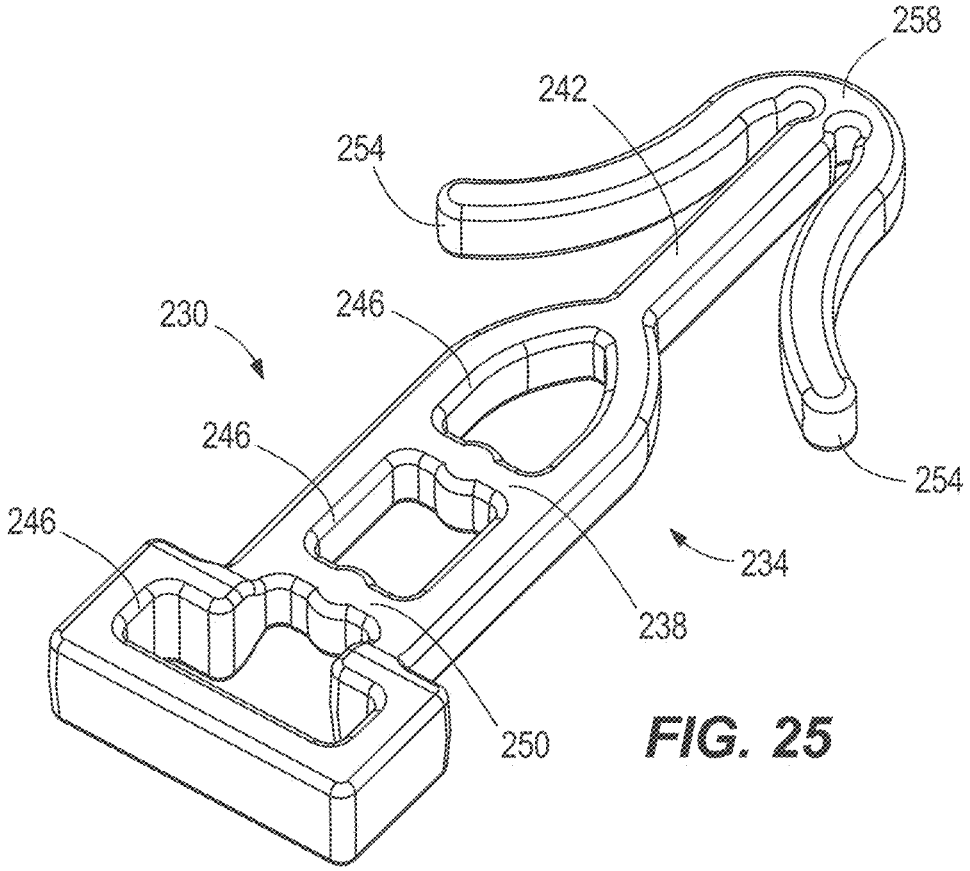
FIG. 25 is a rear perspective view of the locking pin of FIG. 24.

FIGS. 24 and 25 illustrate a locking pin 230 according to another embodiment of the invention. The locking pin 230 is similar to the locking pin 186 described above, and the following differences are explained below. The locking pin 230 includes an elongated body 234. The locking pin 230 does not include a clip as described above for the previous embodiment. The locking pin 230 may be used with the case 202 including the latch 198 and the lip 214 described above (i.e., locking pin 230 is used with a small case 202 with a small latch 198).

With reference to FIGS. 24 and 25, the elongated body 234 includes a tab 238 and an extension 242. The tab 238 defines an aperture 246. In the illustrated embodiment, the tab 238 defines two apertures 246. In other embodiments, the tab 238 defines one, two, three, four, or any number of apertures 246. The tab 238 further includes a breakable body 250 that allows the elongated body 234 to be disconnected or broken from the tab 238. The breakable body 250 allows the locking pin 230 to be removed to access the contents of the case 202.

As shown in FIGS. 24 and 25, the extension 242 extends from the tab 238. The extension 242 includes wings 254. In the illustrated embodiment, the extension 242 includes two wings 254. The wings 254 of the extension 242 may include an arrowhead shape or curved shape. The wings 254 extend from an end 258 of the extension 242 rearward towards the tab 238.

Figure 26:
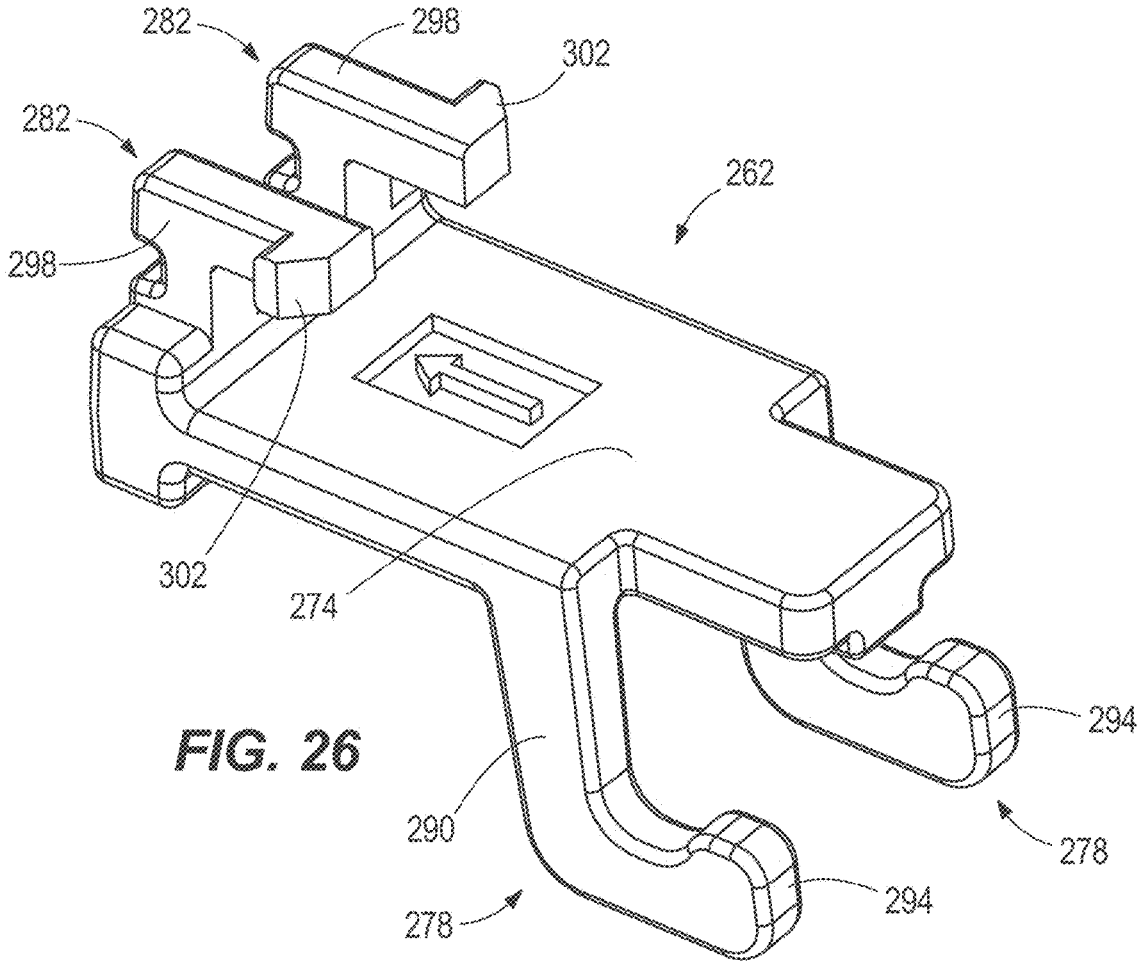
FIG. 26 is a perspective view of a locking pin according to an embodiment of the invention.
Figure 27:
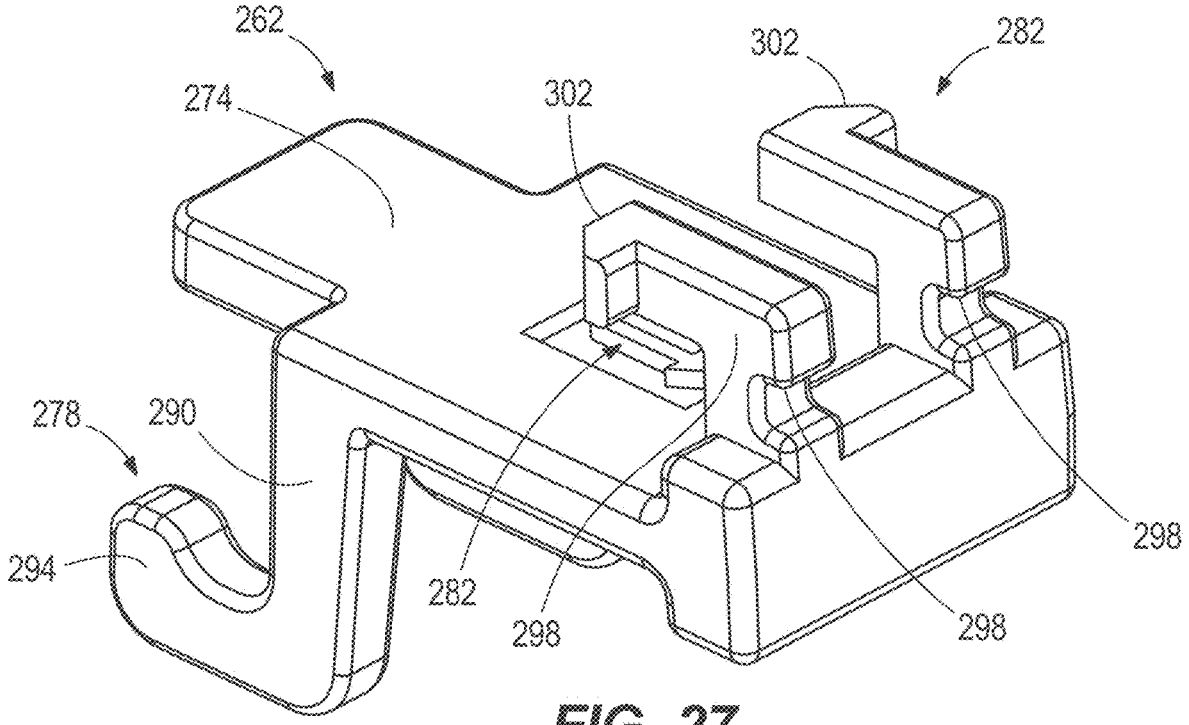
FIG. 27 is a rear perspective view of the locking pin of FIG. 26.
Figure 28:
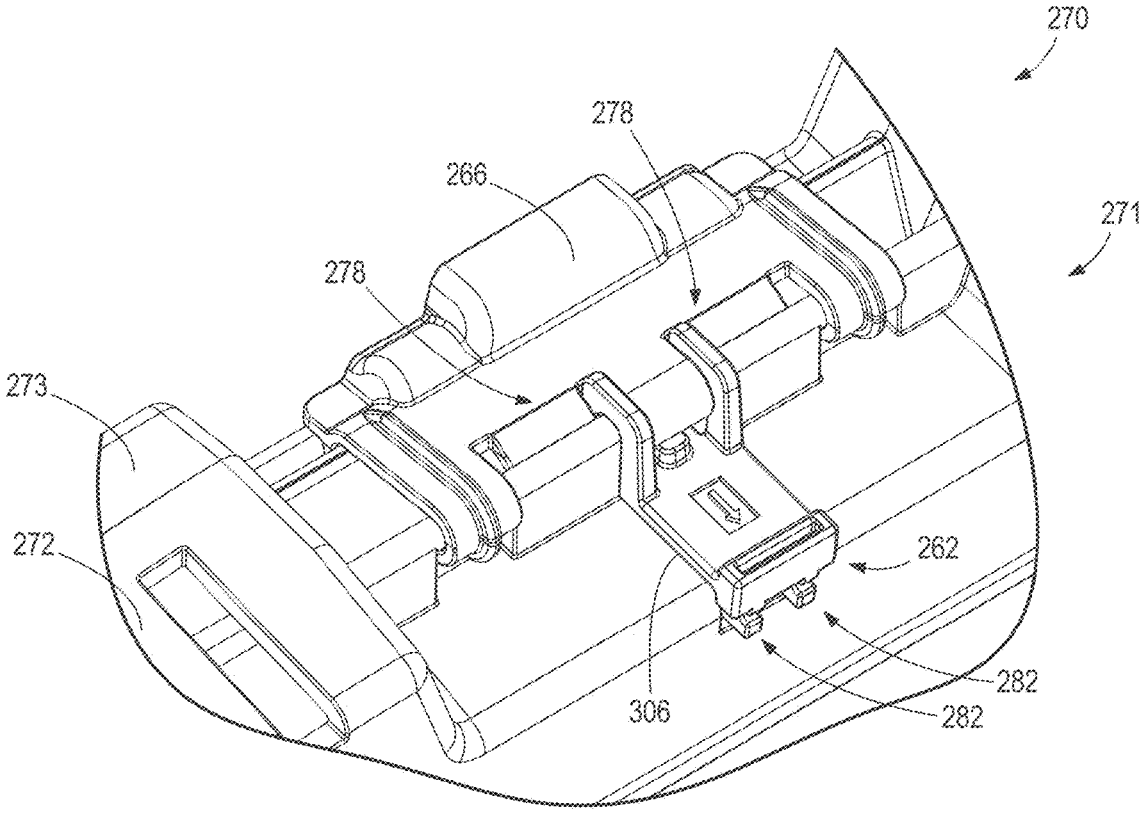
FIG. 28 is a perspective view of the locking pin of FIG. 26 installed on a tool case including a latch.
Figure 29:
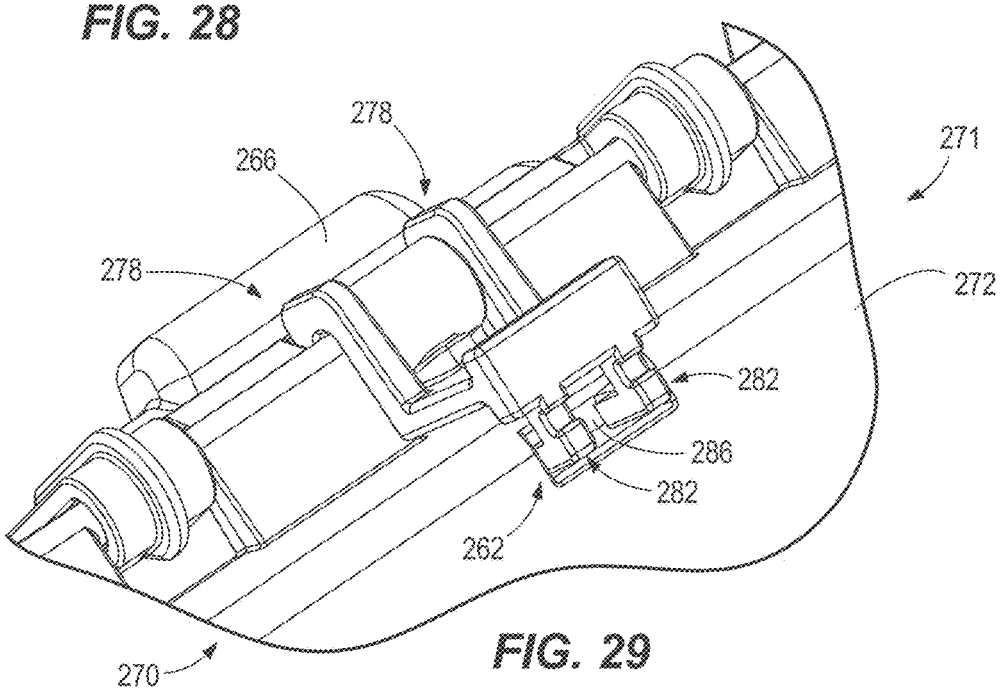
FIG. 29 is another perspective view of the locking pin of FIG. 26 installed on the tool case.

FIGS. 26 and 27 illustrate a locking pin 262 according to another embodiment of the invention. The locking pin 262 is configured to lock a latch 266 of a case 270 (FIGS. 28 and 29) to inhibit unauthorized access to the contents of the case 270. The case 270 includes a base 271 having a lower surface (not shown) with a plurality of base walls 272 extending from the lower surface. The lower surface and base walls 272 define a cavity (not shown). A lid 273 is movably coupled to the base 271 by a hinge (not shown). The lid 273 is moveable between an open position and a closed position to selectively enclose the cavity. FIGS. 28 and 29 illustrate the lid 273 in the closed position.

The locking pin 262 includes a base 274, a first hook element 278, and a second hook element 282. The first hook element 278 receives a portion of the latch 266 to prevent rotation of the latch 266. The second hook element 282 is inserted into an opening 286 in the base walls 272 of the case 270 to secure the locking pin 262 to the case 270.

With continued reference to FIGS. 26 and 27, the locking pin 262 includes the first hook element 278. In the illustrated embodiment, the locking pin 262 includes two first hook elements 278. Each first hook element 278 includes a first base portion 290 and a first hook portion 294. The first base portion 290 is integrally formed with the base 274. The first base portion 290 extends approximately perpendicular to the base 274. The first hook portion 294 extends approximately perpendicular to the first base portion 290. The latch 266 receives (e.g., slots or apertures formed in the latch 266) the first hook portion 294 to prevent rotation of the latch 266.

As shown in FIGS. 26 and 27, the locking pin 262 includes the second hook element 282. In the illustrated embodiment, the locking pin 262 includes two second hook elements 282. Each second hook element 282 includes a second base portion 298 and a second hook portion 302. The second base portion 298 is integrally formed with the base 274. The second base portion 298 extends over the base 274. The second hook portion 302 extends approximately perpendicular to the second base portion 298. In other embodiments, the second hook portion 302 extends obliquely from the second base portion 298. The opening 286 of the case 270 receives the second hook portion 302 to secure the locking pin 262 to the case 270.

FIGS. 28 and 29 illustrate the locking pin 262 installed onto the case 270. A user aligns the locking pin 262 with an indentation 306 on the case 270. The user slides the locking pin 262 along the case 270 such that the first hook elements 278 engage the latch 266 of the case 270. The first hook elements 278 prevent rotation of the latch 266. The second hook elements 282 engage the opening 286 of the case 270. The second hook elements 282 secure locking pin 262 to the case 270. To remove the locking pin 262, the user slides the locking pin 262 in a second direction opposite the first direction to disengage the first hook elements 278 from the latch 266, and disengage the second hook elements 282 from the opening 286 of the case 270.

Although the invention has been described in detail with reference to certain preferred embodiments, variations and modifications exist within the scope and spirit of one or more independent aspects of the invention as described.

Various features and advantages of the invention are set forth in the following claims.

What is claimed is:

1. A tool case comprising:

a base;

a lid movably coupled to the base between an open position and a closed position, the lid and the base defining an aperture when in the closed position;

a latch coupled to the base and the lid to selectively restrict movement of the lid relative to the base from the closed position to the open position; and a locking pin positioned in the aperture to secure the lid in the closed position, wherein the locking pin includes an elongated body positioned within the aperture, wherein the elongated body is configured to flex when inserted into the aperture, and wherein the elongated body includes wings extending from the elongated body.

2. The tool case of claim 1, wherein the locking pin engages the latch to inhibit movement of the latch relative to the base and the lid.

3. The tool case of claim 2, wherein the locking pin includes a clip, wherein the elongated body extends from the clip, wherein the clip engages the latch, and wherein the elongated body is positioned in the aperture.

4. The tool case of claim 3, wherein the clip defines a channel for receiving a portion of the latch.

5. The tool case of claim 3, wherein the clip extends perpendicularly from the elongated body.

6. The tool case of claim 5, wherein the locking pin also includes a rib extending along a surface of the clip from a first edge of the clip adjacent the elongated body toward a second edge of the clip opposite the elongated body.

7. The tool case of claim 3, wherein the clip and the elongated body are formed as one integral body.

8. The tool case of claim 1, wherein the wings are configured to flex inwardly as the locking pin is inserted into the aperture, and wherein the wings are configured to expand outwardly after the locking pin is fully inserted into the aperture.

9. The tool case of claim 1, wherein the locking pin includes a tab defining a first shoulder, an extension extending from the tab and defining a second shoulder, and a breakable body between the tab and the extension, and wherein portions of the base and the lid are captured between the first shoulder and the second shoulder.

10. A case assembly comprising:

a case including a base, a lid movably coupled to the base between an open position and a closed position, and a latch coupled to the base and the lid to restrict movement of the lid relative to the base, the lid and the base defining an aperture when in the closed position, and a locking pin including an elongated body configured to be inserted into the aperture of the case, the elongated body including wings that are configured to flex inwardly as the locking pin is inserted into the aperture and that are configured to expand outwardly after the locking pin is fully inserted into the aperture to secure the lid in the closed position.

11. The case assembly of claim 10, wherein the locking pin includes a clip extending from the elongated body, and wherein the clip is configured to engage the latch to inhibit movement of the latch relative to the base and the lid.

12. The case assembly of claim 11, wherein the clip defines a channel configured to receive a portion of the latch.

13. The case assembly of claim 11, wherein the clip extends perpendicularly from the elongated body.

14. The case assembly of claim 10, wherein the elongated body defines slots between the wings, and wherein the slots allow the wings to flex inwardly as the locking pin is inserted into the aperture.

15. A method for securing a tool case, the method comprising:

providing the tool case including a base, a lid movably coupled to the base between an open position and a closed position, and a latch coupled to the base and the lid to restrict movement of the lid relative to the base from the closed position to the open position, the lid and the base defining an aperture when in the closed position; and inserting a locking pin into the aperture, the locking pin including an elongated body that expands outwardly after the locking pin is fully inserted into the aperture to secure the lid in the closed position, wherein the elongated body includes wings, and wherein inserting the locking pin includes flexing the wings inwardly as the locking pin is inserted into the aperture and flexing the wings outwardly after the locking pin is fully inserted into the aperture.

16. The method of claim 15, further comprising engaging the latch with the locking pin to inhibit movement of the latch relative to the base and the lid.

17. The method of claim 16, wherein the locking pin includes a clip extending perpendicularly from the elongated body, and wherein engaging the latch includes engaging the latch with the clip.

18. A tool case comprising:

a base;

a lid movably coupled to the base between an open position and a closed position, the lid and the base defining an aperture when in the closed position;

a latch coupled to the base and the lid to selectively restrict movement of the lid relative to the base from the closed position to the open position; and a locking pin positioned in the aperture to secure the lid in the closed position, wherein the locking pin engages the latch to inhibit movement of the latch relative to the base and the lid, wherein the locking pin includes a clip and an elongated body extending from the clip, wherein the clip engages the latch, and wherein the elongated body is positioned in the aperture, and wherein the clip defines a channel for receiving a portion of the latch.

19. A tool case comprising:

a base;

a lid movably coupled to the base between an open position and a closed position, the lid and the base defining an aperture when in the closed position;

a latch coupled to the base and the lid to selectively restrict movement of the lid relative to the base from the closed position to the open position; and a locking pin positioned in the aperture to secure the lid in the closed position, wherein the locking pin engages the latch to inhibit movement of the latch relative to the base and the lid, wherein the locking pin includes a clip and an elongated body extending from the clip, wherein the clip engages the latch, and wherein the elongated body is positioned in the aperture, wherein the clip extends perpendicularly from the elongated body, and wherein the locking pin also includes a rib extending along a surface of the clip from a first edge of the clip adjacent the elongated body toward a second edge of the clip opposite the elongated body.

20. A tool case comprising:

a base;

a lid movably coupled to the base between an open position and a closed position, the lid and the base defining an aperture when in the closed position;

a latch coupled to the base and the lid to selectively restrict movement of the lid relative to the base from the closed position to the open position; and a locking pin positioned in the aperture to secure the lid in the closed position, wherein the locking pin includes a tab defining a first shoulder, an extension extending from the tab and defining a second shoulder, and a breakable body between the tab and the extension, and wherein portions of the base and the lid are captured between the first shoulder and the second shoulder.

* * * * *